US012320120B2

(12) United States Patent
Crowell et al.

(10) Patent No.: US 12,320,120 B2
(45) Date of Patent: Jun. 3, 2025

(54) MODULAR ASSEMBLIES FOR GUTTER GUARD SYSTEMS WITH CUSTOMIZABLE MAIN BODIES AND SCREENS

(71) Applicant: LeafFilter North, LLC, Hudson, OH (US)

(72) Inventors: Jason Alan Crowell, Akron, OH (US); Michael Gori, Norton, OH (US)

(73) Assignee: LeafFilter North, LLC, Hudson, OH (US)

( * ) Notice: Subject to any disclaimer, the term of this patent is extended or adjusted under 35 U.S.C. 154(b) by 201 days.

(21) Appl. No.: 18/051,165

(22) Filed: Oct. 31, 2022

(65) Prior Publication Data

US 2024/0093501 A1 Mar. 21, 2024

Related U.S. Application Data

(63) Continuation-in-part of application No. 17/933,698, filed on Sep. 20, 2022, now Pat. No. 12,098,551.

(51) Int. Cl.
*E04D 13/076* (2006.01)

(52) U.S. Cl.
CPC ..... *E04D 13/076* (2013.01)

(58) Field of Classification Search
CPC . E04D 13/076; E04D 13/0765; E04D 13/064; E04D 13/0445; E04D 13/0725
See application file for complete search history.

(56) References Cited

U.S. PATENT DOCUMENTS

| | | | | | |
|---|---|---|---|---|---|
| 486,868 | A * | 11/1892 | Gogerty | E04D 13/076 | 52/12 |
| 1,349,264 | A * | 8/1920 | Busse | E04D 13/076 | 248/48.1 |
| 1,526,821 | A * | 2/1925 | Andrews | E04D 13/076 | 52/12 |
| 9,127,463 | B1 * | 9/2015 | Feldhaus | E04D 13/076 | |
| 10,655,334 | B2 * | 5/2020 | Gori | E04D 13/076 | |
| 2006/0053697 | A1 * | 3/2006 | Higginbotham | E04D 13/076 | 52/12 |
| 2006/0123710 | A1 * | 6/2006 | Lenney | E04D 13/076 | 52/12 |
| 2006/0179723 | A1 * | 8/2006 | Robins | E04D 13/076 | 52/11 |

(Continued)

*Primary Examiner* — Babajide A Demuren
(74) *Attorney, Agent, or Firm* — Benesch Friedlander Coplan & Aronoff LLP

(57) ABSTRACT

Disclosed herein are various components for configuring, assembling, and customizing modular gutter guard systems for trough-style and built-in gutter systems. Such customizable gutter guard systems are designed and arranged to be positioned across the opening of a trough or box gutter and include a water management features to assist in managing the flow of rainwater across the gutter guard system. The modular assembly includes a number of configurable components for use with a specific trough-style or built-in gutter system based on the trough-style or built-in gutter system's design, size, and/or dimensions and the anticipated volume and flowrate of rainwater flowing to the rain gutter system. Such customizable components include a main body, a mesh screen, and front and rear receivers. The main body and mesh screen can be secured together to form a main body subassembly, and a water management feature can be formed in the main body subassembly.

22 Claims, 34 Drawing Sheets

(56) References Cited

U.S. PATENT DOCUMENTS

| | | | | |
|---|---|---|---|---|
| 2011/0067318 | A1* | 3/2011 | Lenney | E04D 13/076 52/12 |
| 2011/0272344 | A1* | 11/2011 | Higginbotham | E04D 13/076 210/494.1 |
| 2012/0132759 | A1* | 5/2012 | Sager | E04D 13/0762 248/49 |
| 2013/0160377 | A1* | 6/2013 | Sager | E04D 13/076 52/12 |
| 2013/0276378 | A1* | 10/2013 | McCoy | E04D 13/076 52/12 |
| 2014/0215929 | A1* | 8/2014 | Lenney | E04D 13/0725 52/12 |
| 2015/0143756 | A1* | 5/2015 | Higginbotham | E04D 13/076 52/12 |
| 2017/0089071 | A1* | 3/2017 | Smith | E04D 13/076 |
| 2018/0216348 | A1* | 8/2018 | Morris | F16B 2/243 |
| 2019/0218784 | A1* | 7/2019 | Gori | E04D 13/076 |
| 2019/0330851 | A1* | 10/2019 | Gori | E04D 13/072 |
| 2020/0040583 | A1* | 2/2020 | Gori | E04D 13/076 |
| 2020/0308839 | A1* | 10/2020 | Neeb | E04D 13/068 |
| 2020/0347606 | A1* | 11/2020 | Lenney | E04D 13/068 |
| 2020/0378128 | A1* | 12/2020 | Iannelli | B01D 39/12 |

* cited by examiner

440

MODULAR ASSEMBLIES FOR GUTTER GUARD SYSTEMS WITH CUSTOMIZABLE MAIN BODIES AND SCREENS

CROSS-REFERENCE TO RELATED APPLICATIONS

This application is a continuation-in-part of and claims priority to pending U.S. patent application Ser. No. 17/933,698, titled "Modular Assemblies for Gutter Guard Systems with Customizable Main Bodies and Screens," filed on Sep. 20, 2022, which is expressly incorporated by reference herein in its entirety.

FIELD OF INVENTION

The present disclosure generally relates to systems and methods for preventing debris from entering rain gutters while optimizing rainwater flow and infusion into the rain gutter. More specifically, the present disclosure relates to modular assemblies for gutter guard systems with components that can be assembled to form a gutter guard system with customizable arrangements and dimensions to accommodate a variety of roof and gutter configurations.

BACKGROUND

Rain gutter systems are commonly used for residential homes, buildings, and other structures to manage rainwater by collecting the rainwater and channeling that rainwater away from the structure. Such management of rainwater can be critical for the overall maintenance and condition of the structure by reducing or eliminating damage to the structure and its foundation that can be caused by the uncontrolled flow of rainwater. Gutter guards are components or systems that are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system. Unfortunately, prior art gutter guard systems do not effectively channel rainwater away from a structure. Inefficient rainwater management designs, matting of debris onto the gutter guard system over time, and ill-fitting gutter guard systems cause unnecessary damage to homes and other structures, which reduces property values, increases maintenance costs, and causes dangerous conditions for occupants of structures.

Gutter guards are typically manufactured to fit a specific style and specific size of rain gutter. Such gutter guards are typically manufactured as a single component or assembly of subcomponents, where the subcomponents are irreversibly joined together. Thus, gutter guard manufacturers, distributors, and/or dealers typically choose between making and/or stocking a limited number of products that accommodate a limited segment of the market or making and/or stocking a large number of products to accommodate the large number of variations of rain gutter guards.

There are many different sizes and styles of rain gutters on the market in the United States and internationally. The differences in rain gutter sizes and styles are driven by a number of factors including different architectural styles for homes and buildings in different geographical regions and regional homebuilder and contractor trade practices that develop over time. Such different architectural styles can also be driven by differences in climate and weather patterns (for example, volume of annual rain and snow fall), historic influences, availability of building materials, and so on. The different architectural styles often dictate the rooflines of structures, which in large part dictates the style and size of rain gutters and how the rain gutter is attached to the structure/roofline. The term "structure" is used herein generically to mean residential homes, multi-residential buildings, office buildings, warehouses, commercial buildings, or any other structures for which rain gutter systems are used to channel rainwater away from the structure. The term "roofline" is used herein generically to mean the intersection of the underside of the roof of a structure with the exterior walls of the structure and/or other proximal exterior features such as rafter tails, fascia board, starter strips, flashing, drip edges, and so on. Once a particular style of rain gutter becomes dominant in a region or market, the regional or local homebuilder and contractor trade practices are heavily influenced by the dominant rain gutter style and homebuilders and installation contractors become accustomed to installing that rain gutter style, thus reinforcing the dominance of the rain gutter style in the geographic region. The particular size of this dominant style gutter is variable due to considerations such as the surface area of the roof of a specific structure and regional architectural influences.

As will be appreciated from the following discussion, the number of variations in types of rain gutters, sizes of rain gutters, mechanisms for securing rain gutters to structures and/or rooflines, etc. creates a plethora of potential combinations of rain gutter arrangements. Thus, designing a generic gutter guard product to accommodate such a large number of potential combinations is a challenge that has yet to be met in the marketplace.

Of the various styles of rain gutters, trough-style and built-in gutter systems present unique problems for manufacturers and distributors of gutter guards. Generally, a trough-style gutter system is a rain gutter system that is integrally incorporated into a roof of a house or other structure. Trough-style gutter systems are incorporated into the roof above the roofline and are often formed from flashing and other common roofing materials. FIGS. 1-3 are schematic illustrations of such trough-style gutter systems. As is illustrated in the figures, a trough-style gutter system 10 includes a trough 12 that extends from the edge of the roofing material 14 (in this example, the edge of the asphalt shingles) to the roofline. The trough is formed by the declining surface of the roof and one or more vertical walls 16 extending upward at the roofline. Within the trough 12 there is one or more apertures 18 that are couple to downspouts (not shown) through which rainwater flows to exit the trough 12. As shown in FIGS. 1-3, the vertical walls 16 can be in part made from flashing material, along with other structural components. The trough 12 can include a lining material such as rubber sheeting or tar paper that assist the rainwater in flowing through the trough 12.

FIG. 4 schematically illustrates an exemplary built-in gutter system 20 in cross-section. Built-in gutter systems 20 are often referred to as box gutter systems. Built-in gutter systems are similar to trough-style gutter systems but includes a separately fabricated "box gutter" that is incorporated into the roof near the roofline. As illustrated is FIG. 4, a built-in box gutter 22 is positioned in a recession formed in the roof near the roofline just below the edge of the roofing material 24. The box gutter 22 includes a downward extending pipe 26 that forms a pathway for rainwater to flow out of the box gutter 22. The downward extension 26 is coupled to a downspout 28 that channels rainwater away from the structure.

Both the trough-style and built-in gutter systems are prone to issues of debris collection in the trough or box gutter and the clogging issues that result from such debris collection. For trough-style gutters, the lining material (rubber sheeting, tar paper, etc.) discussed above functions to protect the structure from water damage. Debris interacting with this lining material can puncture or otherwise damage the lining material, which can result in water passing through the lining material and damages the structure. Additionally, when the roof is arranged at a steep incline and/or the structure is subject to heavy and sustained rainfall, rainwater can flow rapidly into the trough-style and built-in gutter systems, overwhelming such rain gutter systems resulting in rainwater flowing over the rain gutter system and falling to the ground at the base of the home or structure.

Thus, both the trough-style and built-in gutter systems can greatly benefit from the installation of gutter guard systems. However, as will be appreciated, all trough-style gutter systems are custom built and do not adhere to any general standards of design, size, or dimensions. Additionally, built-in gutter systems also include significant customization in general design that facilitates installation of the system into a roof. Thus, built-in gutter systems also do not adhere to standard sizing and dimensions. It will be appreciated that with such diversity in design, size, and dimensions, it is difficult to anticipate the specific requirements and/or challenges for installing a gutter guard system in trough-style or built-in gutter systems because of the unpredictability of the design, size, and dimensions. Because of the variety of requirements, there are no current gutter guard products that are applicable to trough-style and built-in gutter systems.

Therefore, there is a need for gutter guard systems and/or methods of installation for gutter guard protection to accommodate trough-style and built-in gutter systems. Disclosed herein are novel gutter guard systems and methods of installing those gutter guard systems that include customizable arrangements and dimensions to accommodate trough-style and built-in gutter systems.

SUMMARY

A variety of components for configuring and assembling gutter guard systems for trough-style and built-in gutter systems are disclosed and claimed herein. Such gutter guard systems are designed and arranged to be positioned across the opening of a trough or box gutter to prevent debris from entering the rain gutter. Such gutter guard systems are additionally designed and arranged to include water management features to assist in managing the flow of rainwater across the gutter guard system. The modular assembly includes a number of configurable components. Select modular components can be customized to create assemblies that form a gutter guard system for use with a specific trough-style or built-in gutter system based on the trough-style or built-in gutter system's design, size, and/or dimensions and the anticipated volume and flowrate of rainwater flowing to the rain gutter system. Such customizable components are a main body and a mesh screen. The main body and mesh screen can be dimensionally customized to accommodate varying designs of trough-style and built-in gutter systems and sizes of associated troughs and box gutters. The main body and mesh screen can also be customized to include a water management feature to manage the flow of rainwater across the gutter guard system.

In an embodiment, a gutter guard system includes a customizable main body, a customizable mesh screen, a front receiver, and a rear receiver. The customizable main body includes a top surface, a bottom surface, a front edge, and a rear edge, and the main body is arranged to be trimmed to custom dimensions. Similarly, the customizable mesh screen includes a top surface, a bottom surface, a front edge, and a rear edge, and the mesh screen is arranged to be trimmed to custom dimensions, typically to match the custom dimensions of the main body. The main body and mesh screen are arranged to be optionally bent or otherwise physically manipulated to form a water management feature extending laterally across the lengths of the main body and mesh screen respectively. Once assembled, the mesh screen is positioned on the top surface of the main body, the front receiver is positioned along the front edges of the main body and mesh screen, and the rear receiver is positioned along the rear edges of the main body and mesh screen. The main body is constructed from a plurality of metal rods arranged in a lattice structure, where the metal rods can be welded together and spaced approximately one inch apart. The mesh screen is constructed from a plurality of threads woven into a lattice structure, where the threads are made from 316L stainless steel wire with a diameter of approximately 0.0085 inches. The threads are arranged in the lattice such that there are approximately 30 threads per linear inch in both directions of the lattice. This results in a mesh screen with an open area of approximately fifty-five percent.

In another embodiment, a gutter guard system includes a customizable main body subassembly, a front receiver, and a rear receiver. The customizable main body subassembly comprises a mesh screen secured to a main body. The main body subassembly is arranged to be trimmed to custom dimensions to accommodate trough-style and built-in gutter systems. The main body subassembly is further arranged to be optionally bent or otherwise physically manipulated to form a water management feature extending laterally across the length of the main body subassembly. Once assembled, the front receiver is positioned along a front edge of the main body subassembly, and the rear receiver is positioned along a rear edges of the main body subassembly.

In another embodiment, the front receiver includes an upper member running the length of the front receiver, a lower member running the length of the front receiver, a connecting member connecting the upper member and lower member, and a leg extending downward from the upper member. A channel is formed by the upper member, lower member, connecting member, and the leg. Once assembled with the main body and mesh screen, the front edges of the main body and mesh screen are positioned in the channel. In one example, the front edges of the main body and mesh screen are engaged in a friction fit with the channel. The front receive can be arranged such that the upper member comprises a forward section and a rearward section, wherein the forward section extends at a downward angle from the rearward section.

In another embodiment, the rear receiver includes an upper member running the length of the rear receiver, a lower member running the length of the rear receiver, a connecting member connecting the upper member and lower member, and a leg extending downward from the upper member. A channel is formed by the upper member, lower member, connecting member, and the leg. Once assembled with the main body and mesh screen, the rear edges of the main body and mesh screen are positioned in the channel. In one example, the rear edges of the main body and mesh screen are engaged in a friction fit with the channel. The rear receive can be arranged such that the upper member comprises a forward section and a rearward section, wherein the rearward section extends at an upward angle from the forward section.

In another embodiment, the rear receiver includes a first member running the length of the rear receiver, a second member running the length of the rear receiver, and a connecting member connecting the first member and second member. A first end of the connecting member terminates at its connection with the first member and a second end of the connecting member extending past the second member and terminating in space. A channel is formed by the first member, second member, and a portion of the connecting member. Once assembled with the main body and mesh screen, the rear edges of the main body and mesh screen are positioned in the channel.

In one example, the dimensions of the gutter guard system can be customized by trimming the main body and mesh screen along a line that is generally parallel to the front edges and rear edges of the main body and mesh screen. In another example, the dimensions of the gutter guard system can be customized by trimming the main body and mesh screen along a line that is generally at an angle to the front edges and rear edges of the main body and mesh screen, for example, a forty-five degree angle. In yet another embodiment, the main body and mesh screen can be bent along three spaced apart lines that are all generally parallel to the front edges and rear edges of the main body and mesh screen to form a water management feature with a triangular cross section that rises above the top surfaces of the main body and mesh screens and extends laterally along the width of the main body and mesh screen.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of modular assembles that include a number of customizable components that can be assembled to form gutter guard systems for use with trough-style gutter and built-in gutter systems are hereinafter disclosed and described in detail with reference made to FIGS. 1-34.

As will be described in detail herein, an embodiment of a novel gutter guard system includes four main components: a main body, a mesh screen, a front receiver, and a rear receiver. Such components can be customized and assembled to form a gutter guard system and subsequently positioned proximate to the top opening of a trough of a trough-style gutter system or proximate to the top opening of a box gutter of a built-in gutter system to provide such rain gutter systems with protection against debris and other unwanted materials from entering the rain gutter system and protection against rapidly flowing rainwater caused by steep roofs and/or heavy rainfalls.

Figure 5:
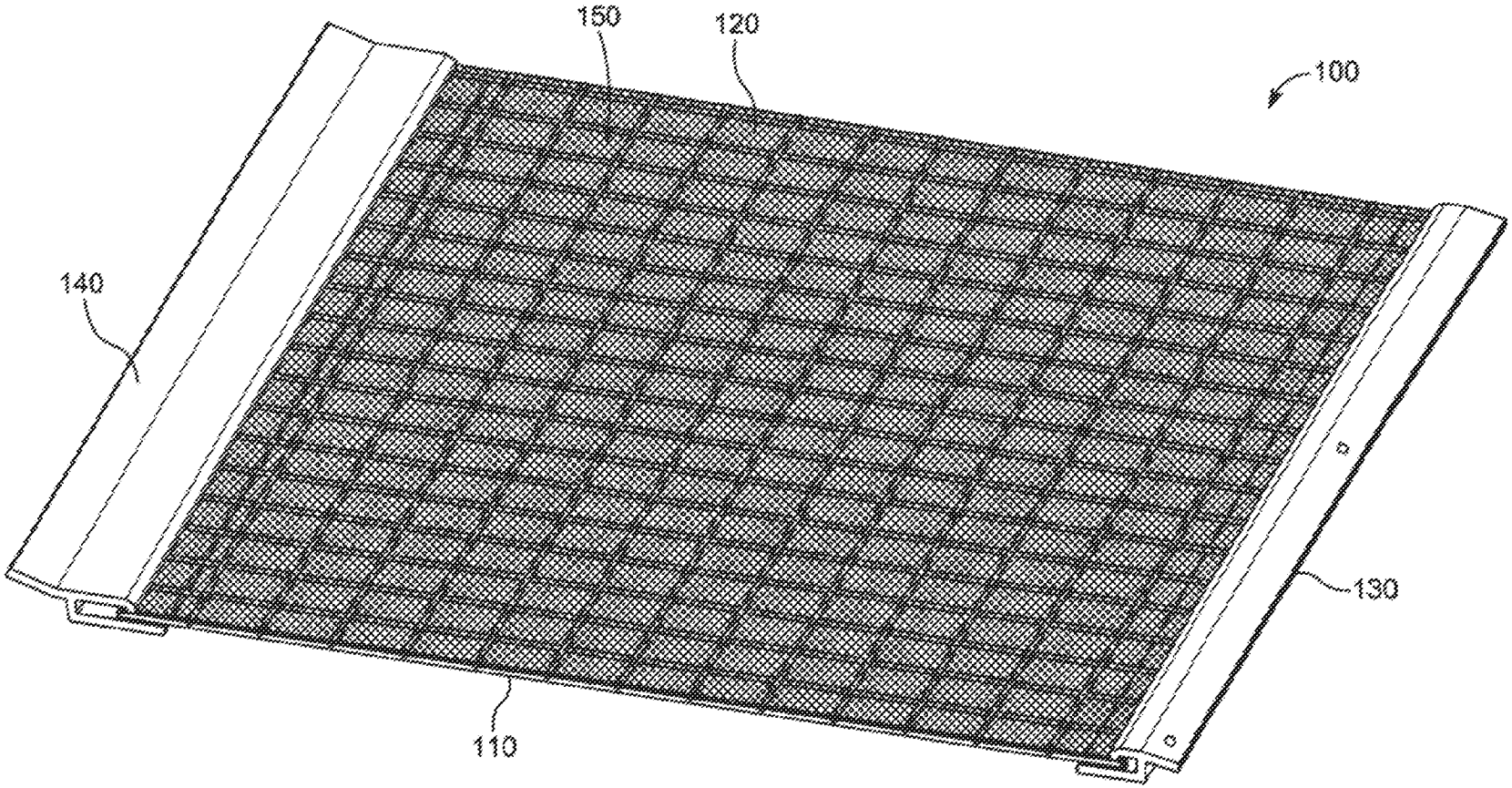
FIG. 5 schematically illustrates a perspective view of an exemplary gutter guard system assembly.
Figure 6:
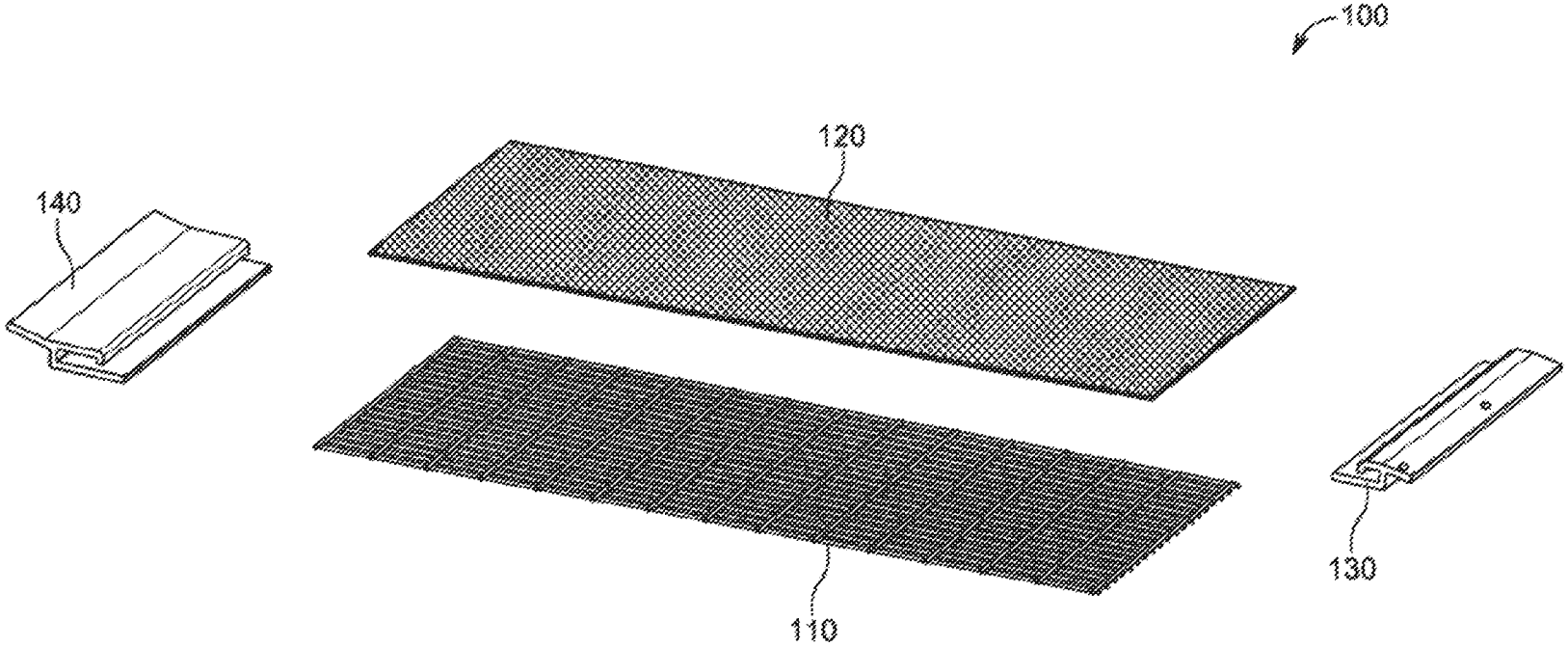
FIG. 6 schematically illustrates an exploded view the gutter guard system of FIG. 5.

FIGS. 5 and 6 illustrate an exemplary gutter guard assembly 100. As noted, the gutter guard assembly 100 includes a main body 110, a mesh screen 120, a front receiver 130, and a rear receiver 140. When the gutter guard assembly 100 is assembled, the mesh screen 120 is positioned on top of the main body 110 to form a main body subassembly 150. A front receiver 130 is coupled to the front edge of the main body subassembly 150, and a rear receiver 140 is coupled to the rear edge of the main body subassembly 150.

Figure 7:
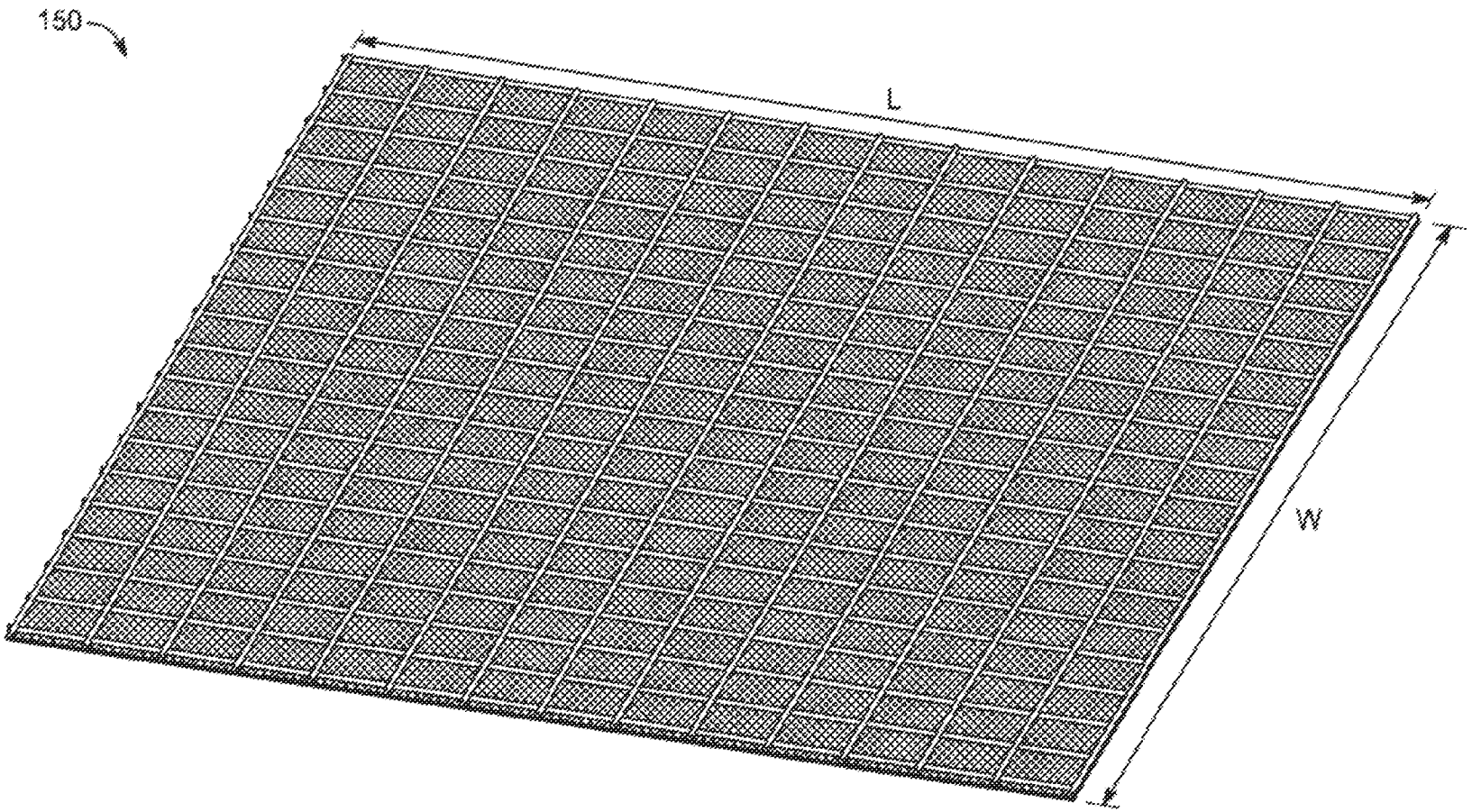
FIG. 7 schematically illustrates a perspective view of a main body and mesh screen assembly as viewed from beneath the assembly for use with the gutter guard system of FIG. 5.
Figure 8:
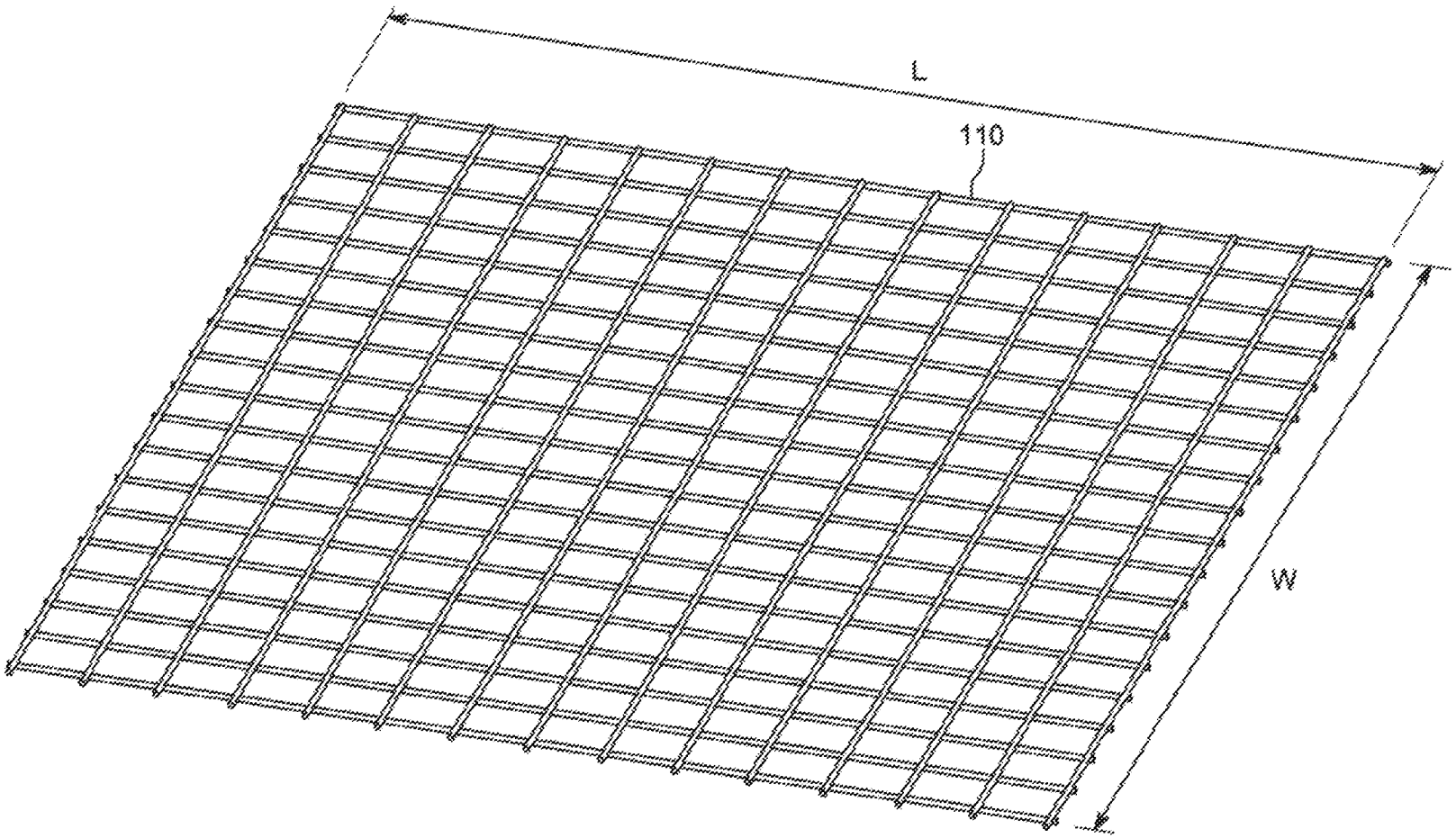
FIG. 8 schematically illustrates a perspective view of a main body for use with the gutter guard system of FIG. 5.

FIGS. 7 and 8 illustrate the main body subassembly 150 and main body 110, respectively. As illustrated in the figures, the main body subassembly 150 and main body 110 are generally flat and thin components with a width (W) and length (L). In the exemplary embodiment, the main body 110 is a series of thin metal rods welded together to form a lattice structure with the rods evenly spaced apart by approximately one inch along both the length (L) and width (W) of the main body 110. The structure of the main body 110 forms a support structure for the mesh screen 120 (which will be discussed subsequently). While the exemplary embodiment of the main body 110 is described as a series of thin metal rods welded together, it will be understood that other materials and arrangements can be used to achieve the functionality of forming a main body to support the mesh screen.

In the exemplary embodiment, the mesh screen 120 is a series of threads secured together to form a lattice structure with the threads evenly spaced apart along the width (W) and length (L) of the mesh screen 120. In one embodiment, the threads are made of 316L stainless steel wire with a diameter of 0.0085 inches. The wires are secured together through weaving and spaced evenly along the length (L) and width (W) such that there are approximately thirty threads per inch along both the length (L) and width (W) of the mesh screen 120. In such an arrangement, the surface area of the screen includes approximately 55% open area. The mesh screen 120 forms a structure that provides a plurality of openings for rainwater to pass through; however, at the same time creates a barrier that stops unwanted debris from passing through the mesh screen 120. While the exemplary embodiment of the mesh screen 120 is described as a specific metal wire woven together, it will be understood that other materials and arrangements can be used to achieve the functionality of forming a mesh screen that simultaneously allows rainwater to pass through the mesh screen and stops unwanted debris from passing through the mesh screen.

In one embodiment, the mesh screen 120 can be positioned on top of the main body 110 and reply on the engagement of the mesh screen 120 and main body 110 with the front 130 and rear 140 receivers to maintain the position of the mesh screen 120. In another embodiment, the mesh screen 120 can be directly secured to the main body 110 by a spot welding process, adhesives, or other such methods.

Figure 9:
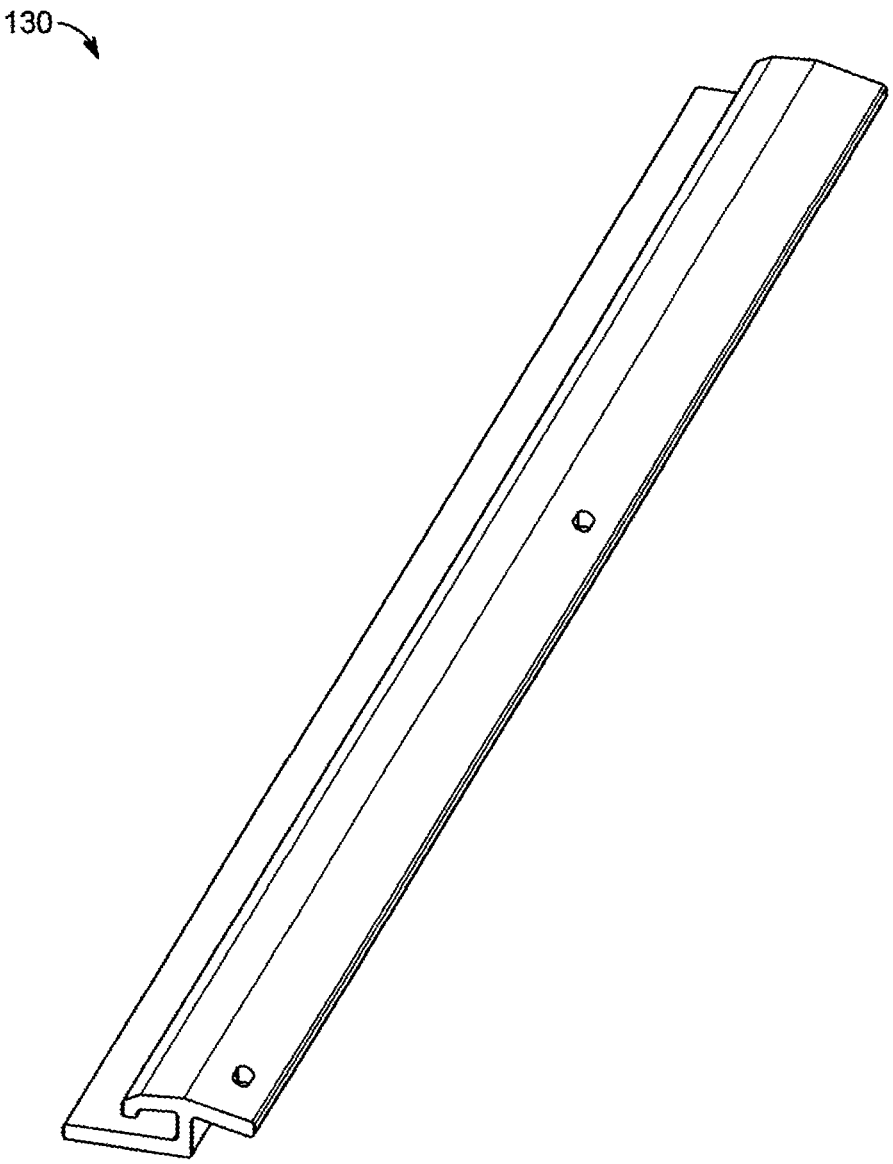
FIG. 9 schematically illustrates a perspective view of a front receiver for use with the gutter guard system of FIG. 5.
Figure 10:
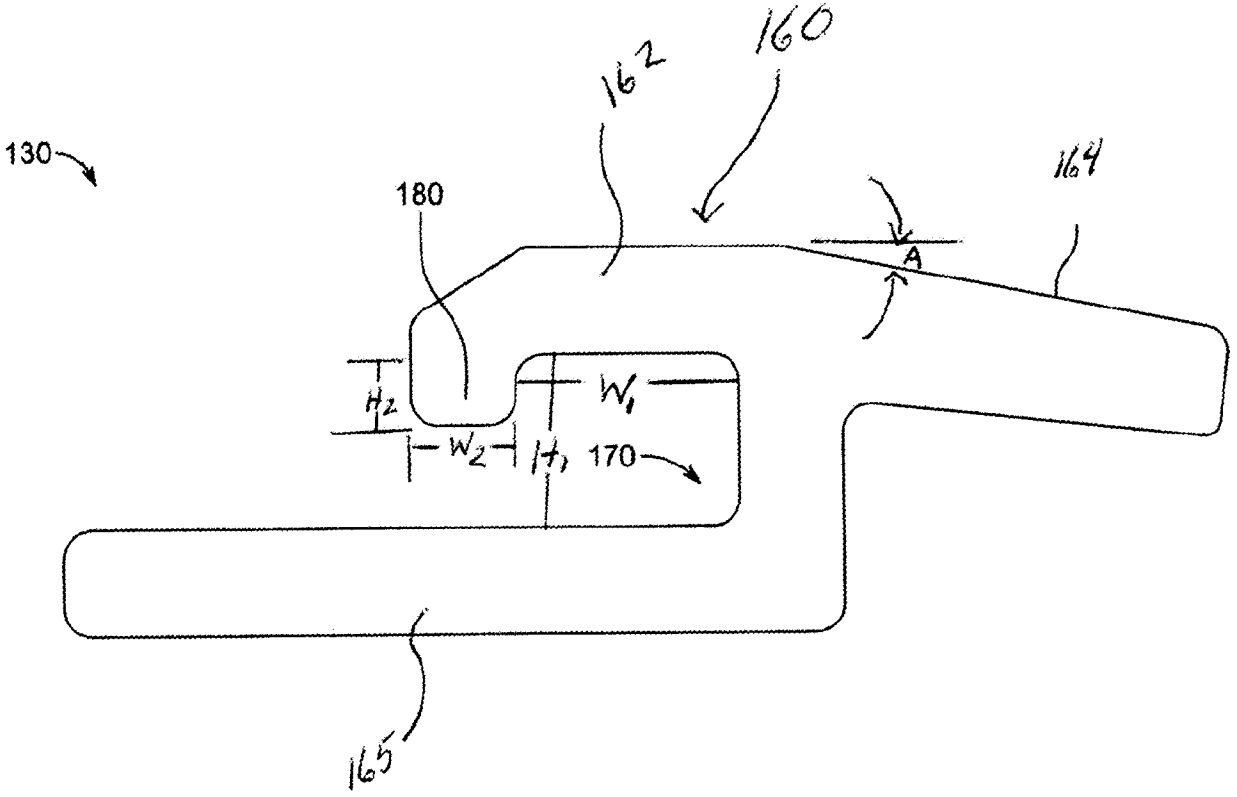
FIG. 10 schematically illustrates a side view of the front receiver of FIG. 9.

FIGS. 9 and 10 schematically illustrate an exemplary front receiver 130. The front receiver includes an extending front edge 160, lower front member 165, a channel 170 running along the length of the front receiver 130 between the extending front edge 160 and the lower front member 165, and a leg 180 extending downward from the extending front edge 160 toward the lower front member 165 and into the channel 170. The front receiver 130 can be coupled to the front edge of the main body subassembly 150 by placing the front edge of the main body subassembly 150 in the channel 170 of the front receiver 130. The front receiver 130 can be optionally secured to the main body subassembly 150 though an adhesive, fastener, or other similar means. Conversely, the front receiver 130 can be reversibly coupled to the main body subassembly 150 by sliding the front edge of the main body subassembly 150 into the channel 170 of the front receiver, where the main body subassembly 150 is secured through a friction fit within the channel 170 and the leg 180. In one embodiment, the width $W_1$ of the channel 170 allows the main body subassembly 150 to be selectively positioned within the channel 170, which provides for variability in the overall width of the gutter guard system 100. Such variability in overall width is often helpful in accounting for inconsistencies in trough-style and built-in style gutter systems. In another embodiment, the channel 170 is sized such that the main body subassembly 150 fits snuggly within the channel 170 and the relative position of the front receiver 130 and the main body subassembly 150 is generally fixed. The front receiver 130 can be used to secure the gutter guard assembly 100 to a house or structure. For example, fasteners can be passed through the extending front edge 160 of the front receiver 130 and into the vertical walls 16 extending from the roofline. Such an arrangement will secure the gutter guard assembly 100 to the house or structure. The extending front edge 160 of the front receiver 130 is angled downward, which once secured to the house or structure, will encourage rainwater to flow over the extended from edge 160 and away from the roof.

In one embodiment, the front receiver 130 is arranged as follows. The extending front edge 160 is comprised of two sections—a straight section 162 and an angled section 164. The straight section 162 is arranged such that it is generally parallel with the lower front member 165, and parallel to the main body subassembly 150 once the front receiver 130 is assembled with the main body subassembly 150. The angled section 164 is positioned at an angle A that is approximately 16 degrees as compared to the straight section 162. In this embodiment, the width $W_1$ of the channel 170 is approximately 0.226 inches and the height $H_1$ of the channel 170 is approximately 0.200 inches. In this embodiment, the width $W_2$ of the leg 180 is approximately 0.125 inches and the height $H_2$ of the leg 180 is approximately 0.082 inches. It will be understood that such dimensions are exemplary only and can be altered to accommodate any number of varying main body subassemblies.

Figure 11:
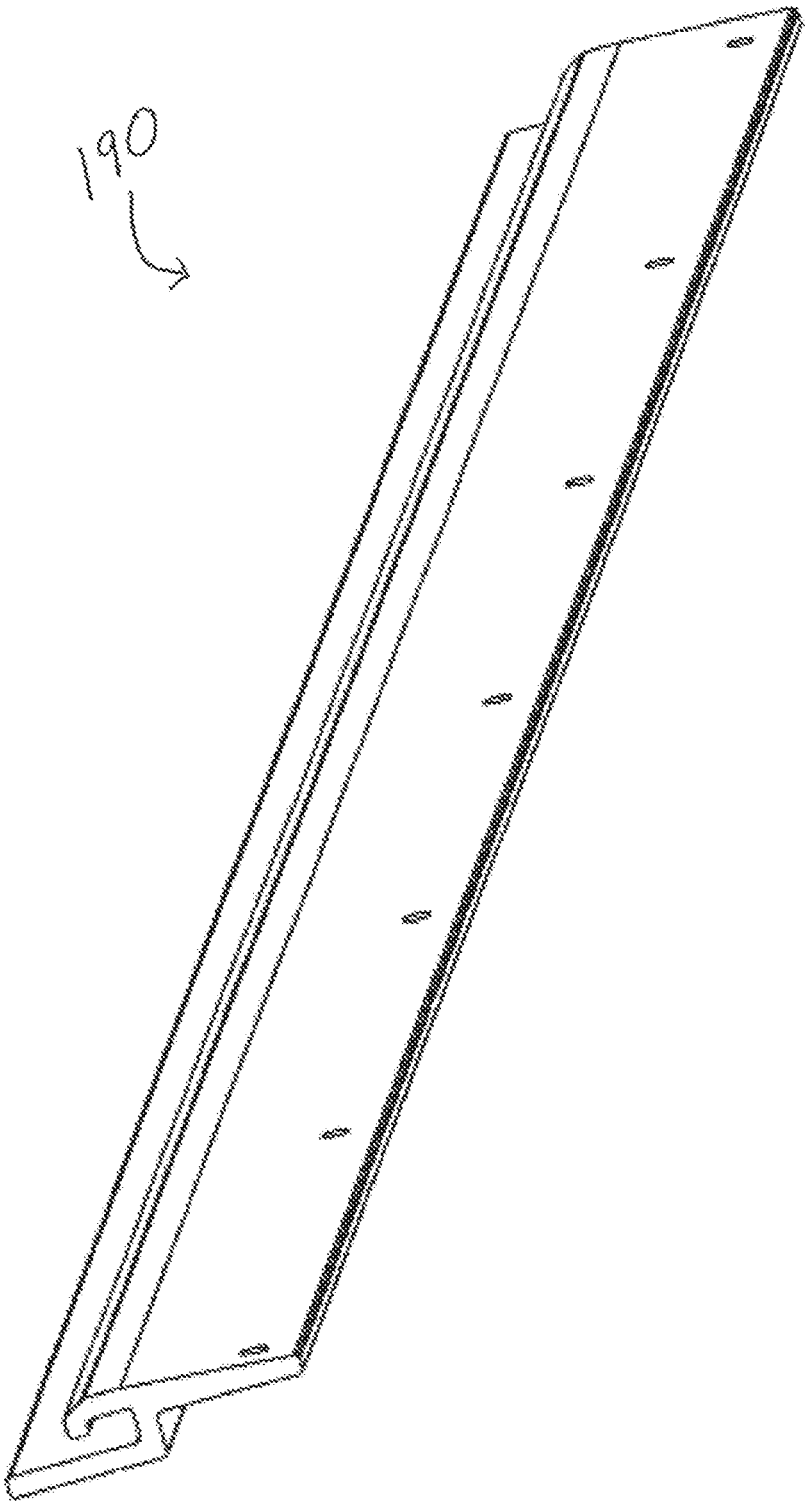
FIG. 11 schematically illustrates a perspective view of another front receiver for use with the gutter guard system of FIG. 5.
Figure 12:
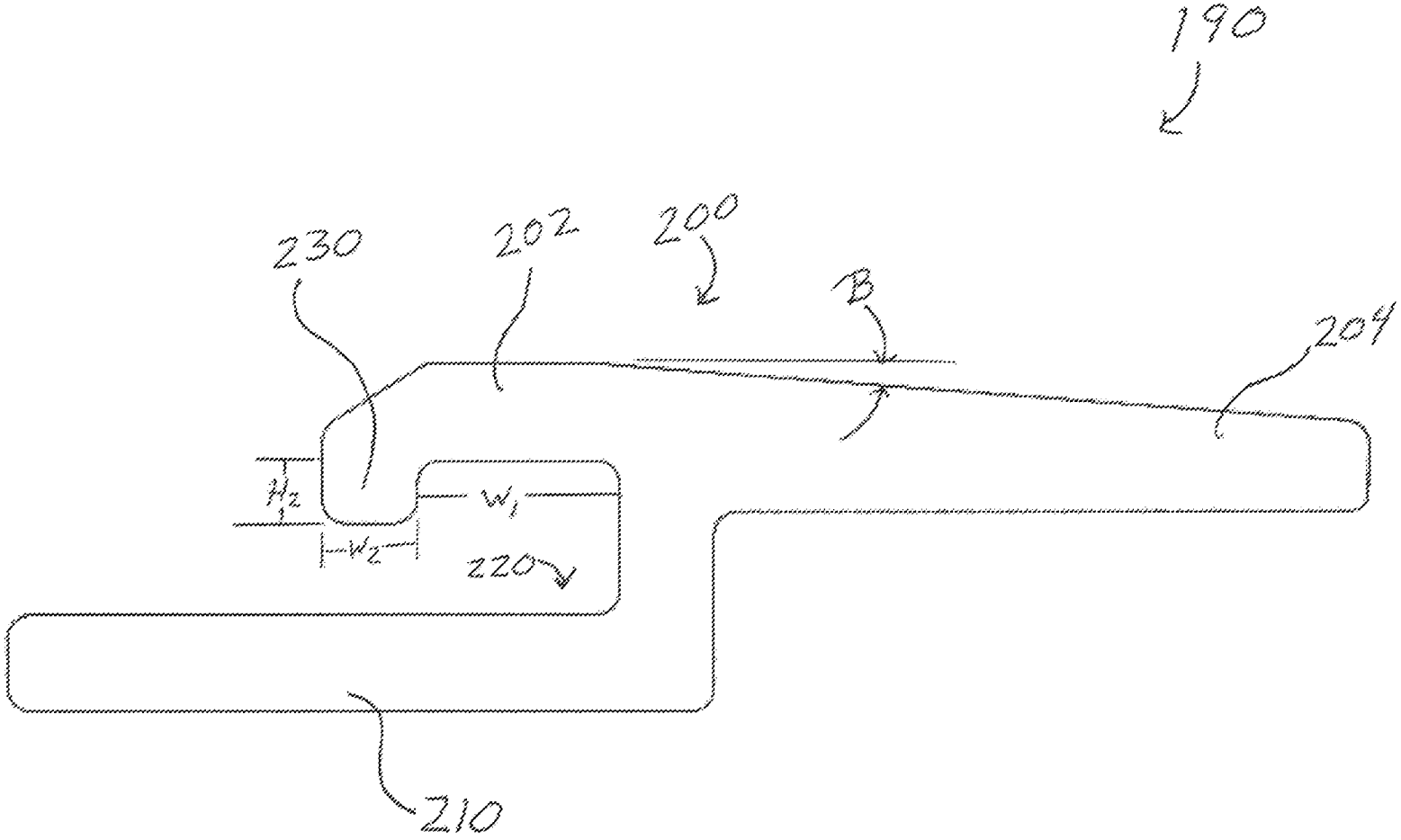
FIG. 12 schematically illustrates a side view of the front receiver of FIG. 11.

FIGS. 11 and 12 illustrate another exemplary embodiment of a front receiver 190. Similar to the embodiment illustrated in FIG. 10, the front receiver 190 includes an extending front edge 200 and a lower front member 210. The extending front edge 200 is comprised of two sections—a straight section 202 and an angled section 204. The straight section 202 is arranged such that it is generally parallel with the lower front member 210, and parallel to the main body subassembly 150 once the front receiver 190 is assembled with the main body subassembly 150. Unlike the front receiver 130 of FIG. 10, the angled section 204 is longer and positioned at an angle B that is approximately 5 degrees as compared to the straight section 202. In this embodiment, the dimensions of a channel 220 and leg 230 are the same as the front receiver 130 of FIG. 10. That is the width $W_1$ of the channel 220 is approximately 0.226 inches and the height $H_1$ of the channel 220 is approximately 0.200 inches. In this embodiment, the width $W_2$ of the leg 230 is approximately 0.125 inches and the height $H_2$ of the leg 230 is approximately 0.082 inches. It will be understood that such dimensions are exemplary only and can be altered to accommodate any number of varying main body subassemblies.

Figure 13:
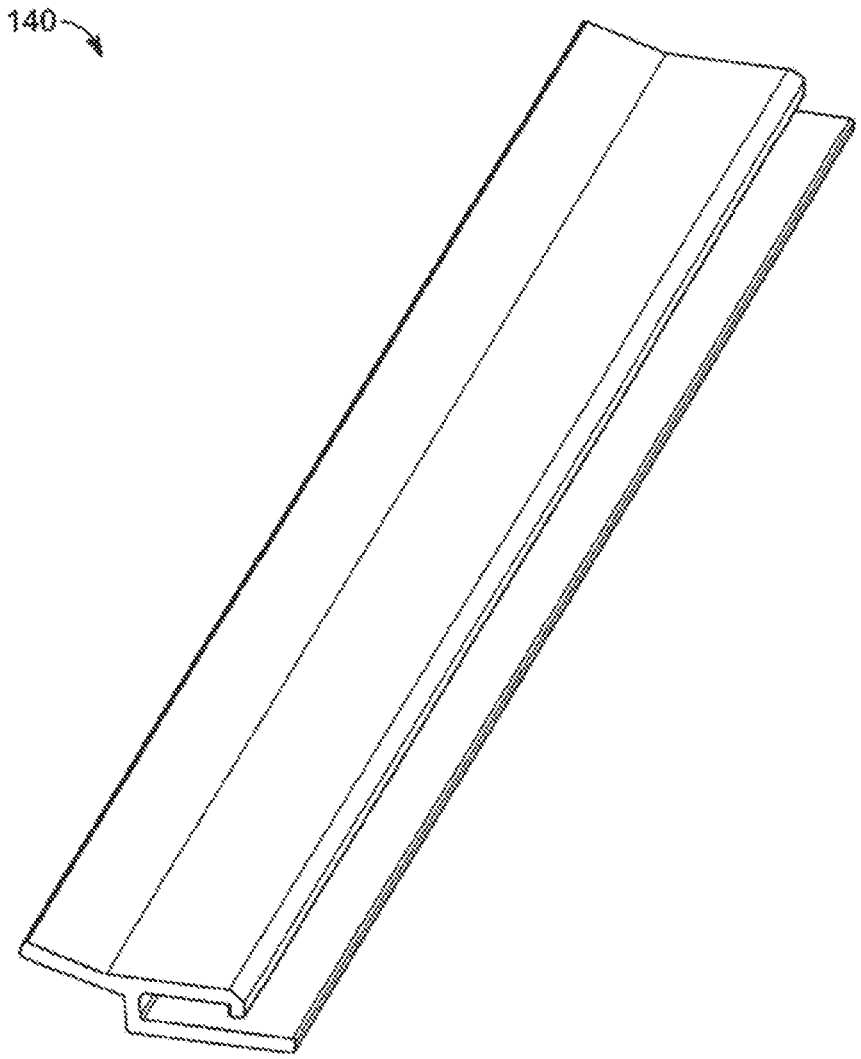
FIG. 13 schematically illustrates a perspective view of a rear receiver for use with the gutter guard system of FIG. 5.
Figure 14:
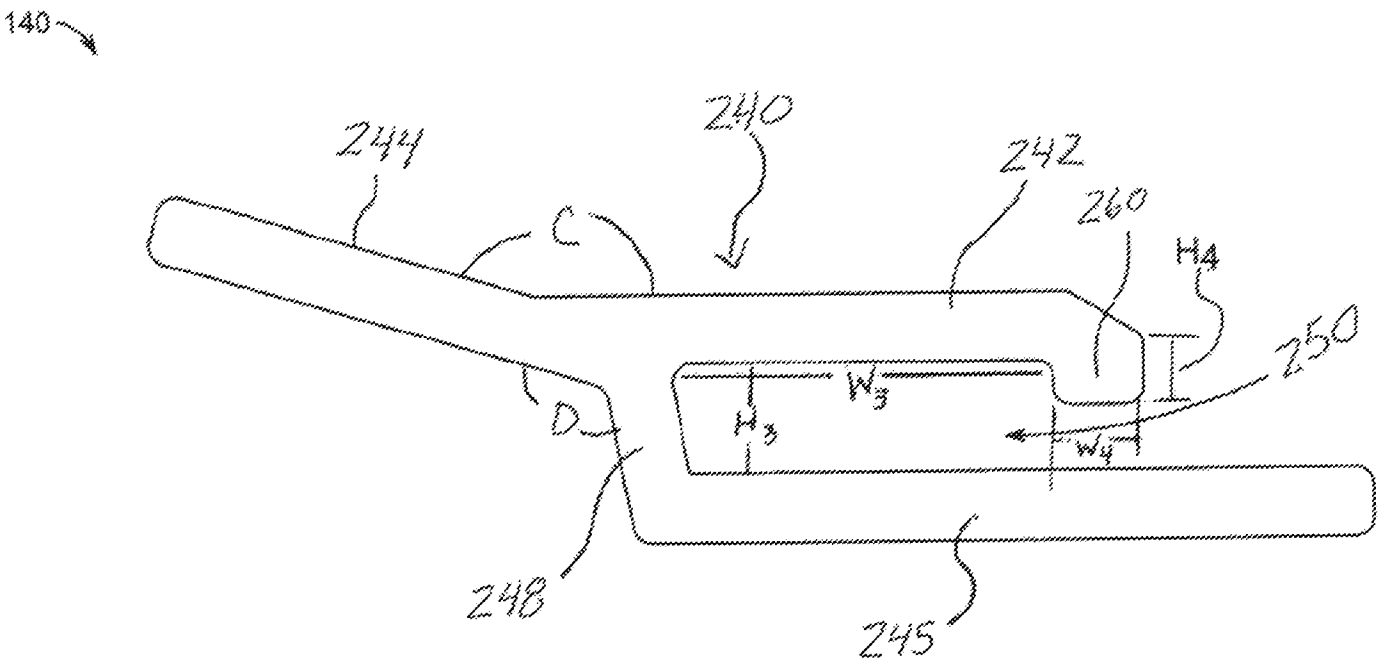
FIG. 14 schematically illustrates a side view of the rear receiver of FIG. 13.

FIGS. 13 and 14 schematically illustrate an exemplary rear receiver 140. The rear receiver 140 includes an extending rear edge 240, a lower rear member 245, a connecting member 248 connecting the extending rear edge 240 and the lower rear member 245, a channel 250 running along the length of the rear receiver 140 between the extending rear edge 240, the lower rear member 245, and the connecting member 248, and a leg 260 extending downward from the extending rear edge 240 toward the lower rear member 245 and into the channel 260. The rear receiver 140 can be coupled to the rear edge of the main body subassembly 150 by placing the rear edge of the main body subassembly 150 in the channel 260 of the rear receiver 140. The rear receiver 140 can optionally be secured to the main body subassembly 150 though an adhesive, fastener, or other similar means. Conversely, the rear receiver 140 can be reversibly coupled to the main body subassembly 150 by sliding the rear edge of the main body subassembly 150 into the channel 250 of the rear receiver 140, where the main body subassembly 150 is secured through a friction fit within the channel 250 and the leg 260. Similar to the channel 170 of the front receiver 130 of FIG. 10, in one embodiment, the width $W_3$ of the channel 250 of the rear receiver 140 allows the main body subassembly 150 to be selectively positioned within the channel 250, which provides for variability in the overall width of the gutter guard system 100. Such variability in overall width is often helpful in accounting for inconsistencies in trough-style and built-in style gutter systems. Furthermore, such selective positioning of the main body subassembly 150 within the channel 250 of the rear receiver 140 allows the main body 150 to be cut along any line running parallel to the rear receive 140 while still providing a friction fit within the channel 250 between the main body subassembly 150 and the leg 260 of the rear receive 140. In another embodiment, the channel 250 is sized such that the main body subassembly 150 fits snuggly within the channel 250 and the relative position of the rear receiver 140 and the main body subassembly 150 is generally fixed. The rear receiver 140 can be used to secure the gutter guard assembly 100 to a house or structure. For example, the extending rear edge 240 of the rear receiver 140 can be positioned under the edge of the roofing material 14 to secure the gutter guard assembly 100 in place. Additionally, in another embodiment, fasteners can be passed through the extending rear edge 244 of the rear receiver 140 and into the roof. Such arrangements will secure the gutter guard assembly 100 to the house or structure. The extending rear edge 244 of the rear receiver 140 is angled downward, which once secured to the house or structure, will encourage rainwater to flow down the roof.

In one embodiment, the rear receiver 140 is arranged as follows. The extending rear edge 240 is comprised of two sections—a straight section 242 and an angled section 244. The straight section 242 is arranged such that it is generally parallel with the lower rear member 245, and parallel to the main body subassembly 150 once the rear receiver 140 is assembled with the main body subassembly 150. The angled section 244 is positioned at an angle C that is approximately 164 degrees as compared to the straight section 242. Additionally, the angle D between the angled section 244 and the connecting member 248 is approximately 117 degrees. In this embodiment, the width $W_3$ of the channel 250 is approximately 0.677 inches and the height $H_3$ of the channel 250 is approximately 0.200 inches. In this embodiment, the width $W_4$ of the leg 260 is approximately 0.163 inches and the height $H_4$ of the leg 260 is approximately 0.082 inches. It will be understood that such dimensions are exemplary only and can be altered to accommodate any number of varying main body subassemblies.

Figure 15:
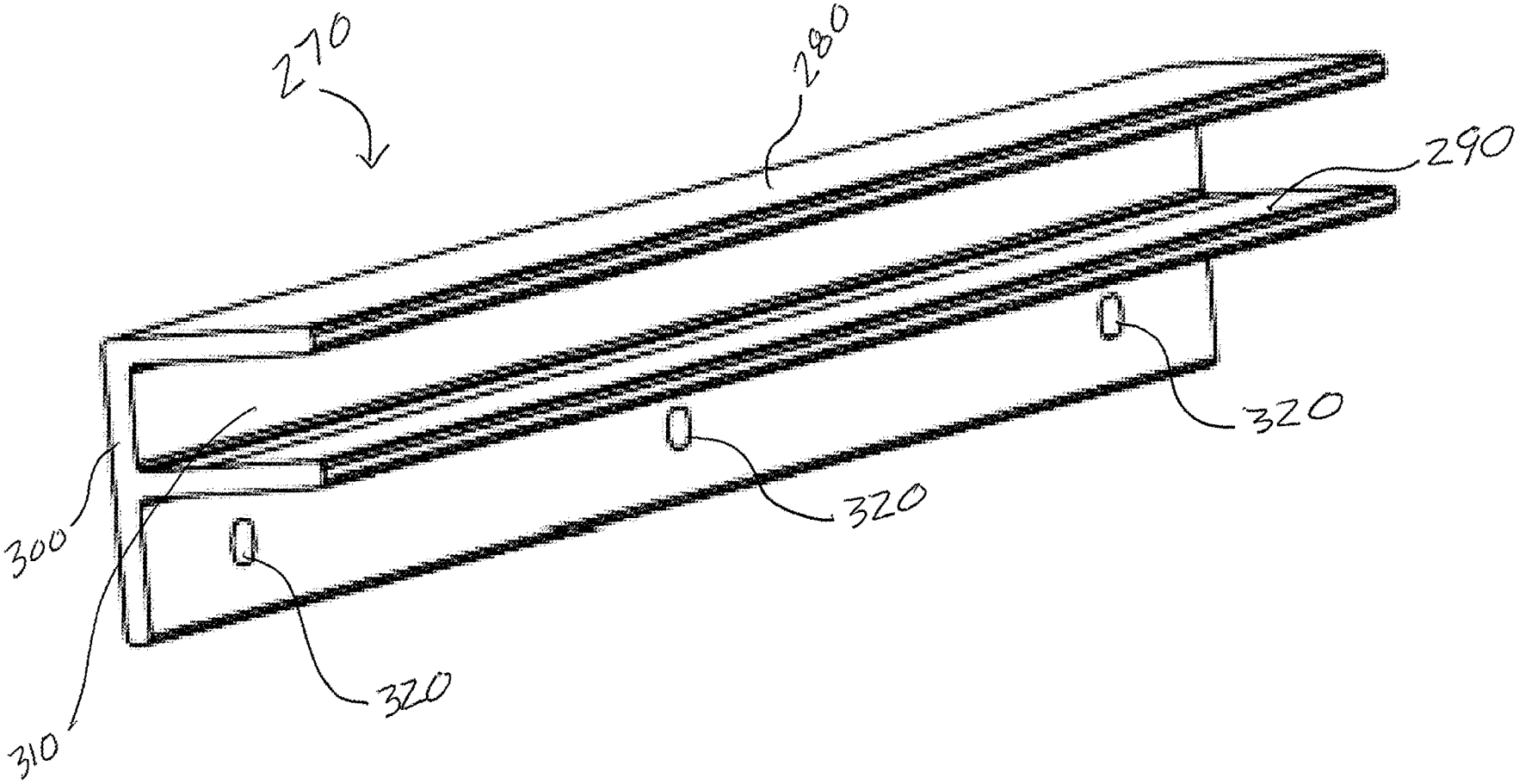
FIG. 15 schematically illustrates a perspective view of another rear receiver for use with the gutter guard system of FIG. 5.
Figure 16:
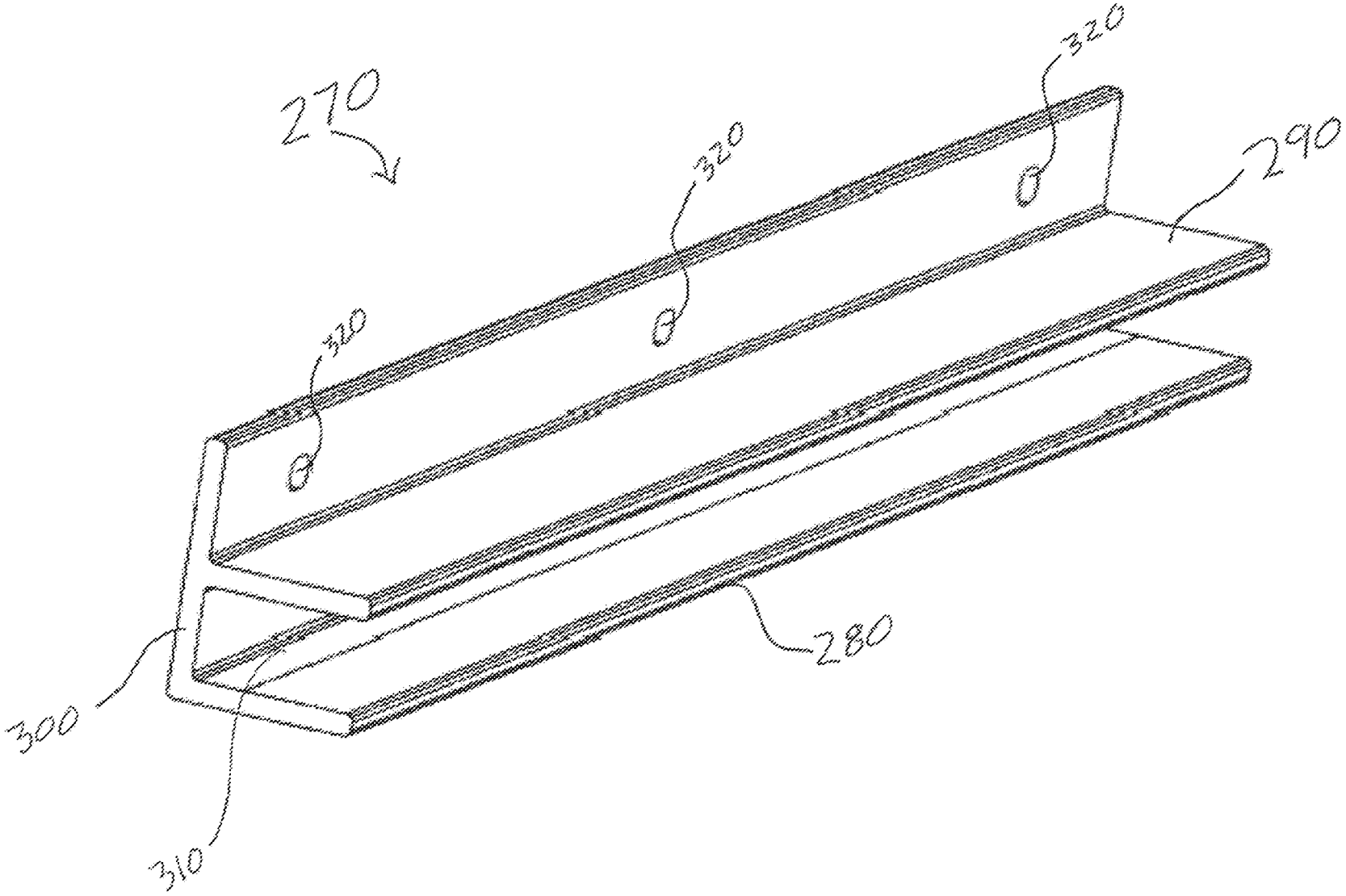
FIG. 16 schematically illustrates another perspective view of the rear receiver of FIG. 15.

FIGS. 15 and 16 illustrate another exemplary embodiment of a rear receiver 270. In this embodiment, the rear receiver 270 includes a first member 280 running the length of the rear receiver 270, a second member 290 running the length of the rear receiver 270 parallel to the first member 280, and a connecting member 300 running the length of the rear receiver 270 that connects the first member 280 and second member 290. The connecting member 300 is generally perpendicular to the first 280 and second 290 members. A first end of the connecting member 300 terminates at its connection with the first member 280 and a second end of the connecting member 300 extending past the second member 290 and terminating in space. A channel 310 is formed between the first member 280, second member 290, and a portion of the connecting member 300. One or more apertures 320 are formed in the connecting member 300 along the length of the rear receiver 270. The illustrations of FIGS. 15 and 16 show only a portion of the rear receiver 270, it will be understood that such rear receivers 270 can be made in any length such as five feet, eight feet, or any other length that is convenient to manufacture, ship, and work within the field.

Figure 17:
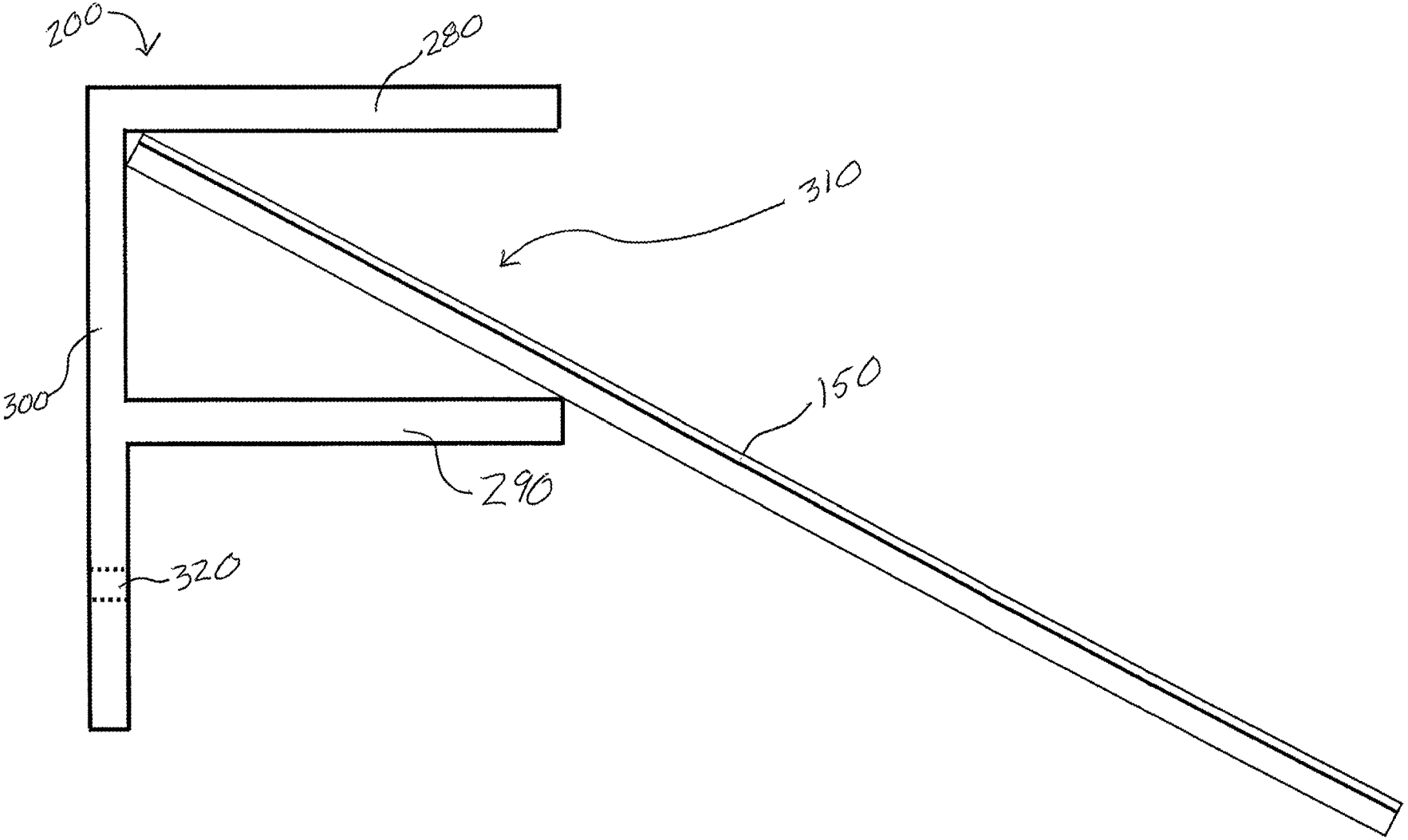
FIG. 17 schematically illustrates a side view of the rear receiver of FIG. 15 engaged with a main body subassembly.
Figure 18:
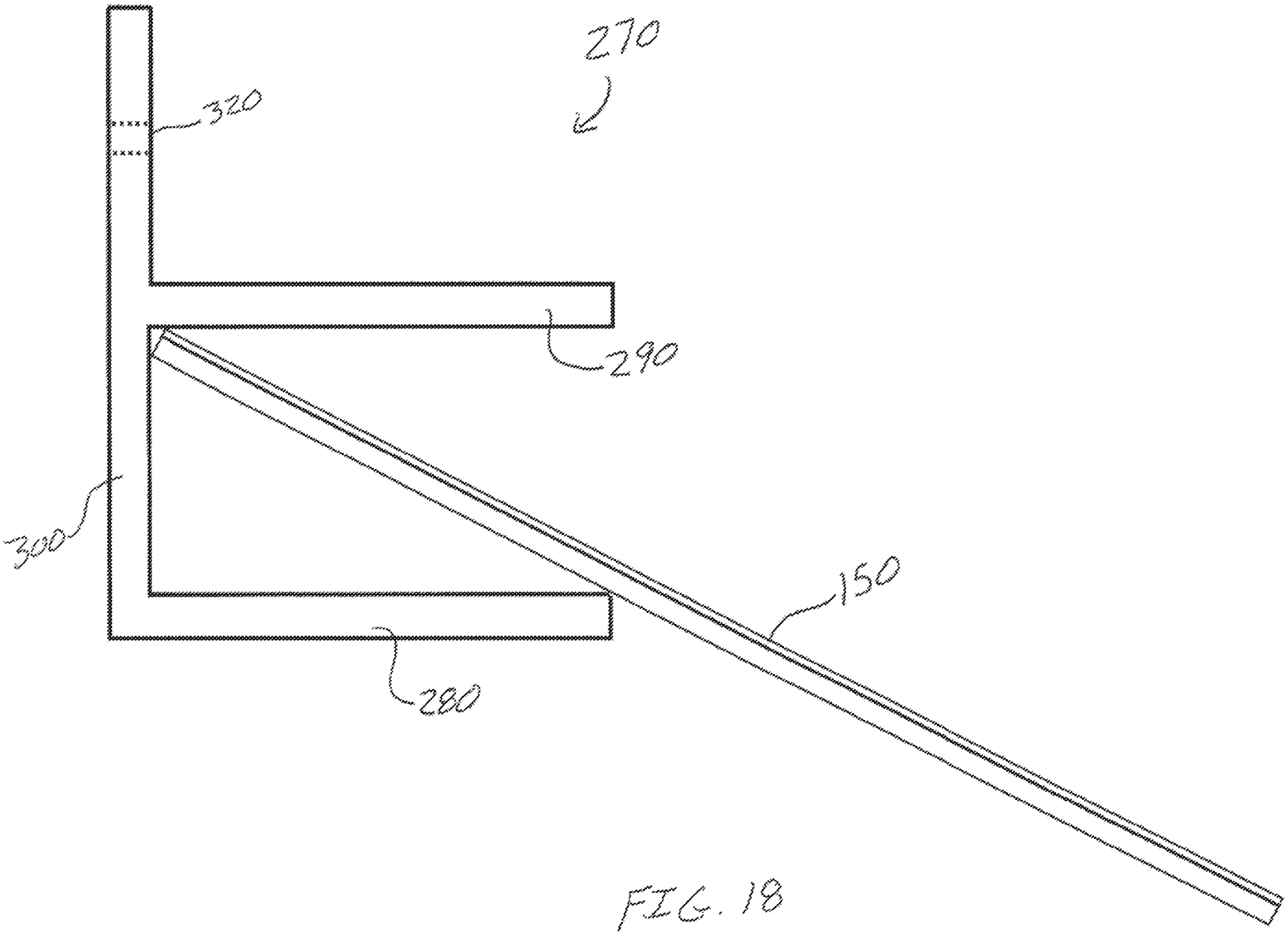
FIG. 18 schematically illustrates another side view of the rear receiver of FIG. 15 engaged with a main body subassembly.

FIGS. 17 and 18 illustrate two potential arrangement for using the rear receiver 270 of FIGS. 15 and 16 to engage with a main body subassembly 150. As illustrated in FIG. 17, in a first arrangement, the rear receiver 270 is arranged so that the first member 280 is positioned above the second member 290. The main body subassembly 150 is then positioned so that the rear edge of the main body subassembly 150 is engaged with the rear receiver 270 at the intersection of the first member 280 and the connecting member 300. The main body subassembly 150 is angled downward so that a section of the main body subassembly 150 engages with the free end of the second member 290.

As illustrated in FIG. 18, in a second arrangement, the rear receiver 270 is arranged so that the second member 290 is above the first member 280. The main body subassembly 150 is then positioned so that the rear edge of the main body subassembly 150 is engaged with the rear receiver 270 at the intersection of the second member 290 and the connecting member 300. The main body subassembly 150 is angled downward so that a section of the main body subassembly 150 engages with the free end of the first member 280.

In both such arrangements illustrated in the figures, the rear receiver 270 (and thus, the assembled gutter guard system) can be secured to a structure by passing fasteners through apertures 320 and into the facia boards or other structural components of the structure. It will be understood that the two arrangements illustrated in FIGS. 17 and 18 are provided to demonstrate the flexibility of the rear receiver 270. The rear receiver 270 can be arranged in a manner that best address the constraints of any particular trough-style or box gutter system.

Figure 19:
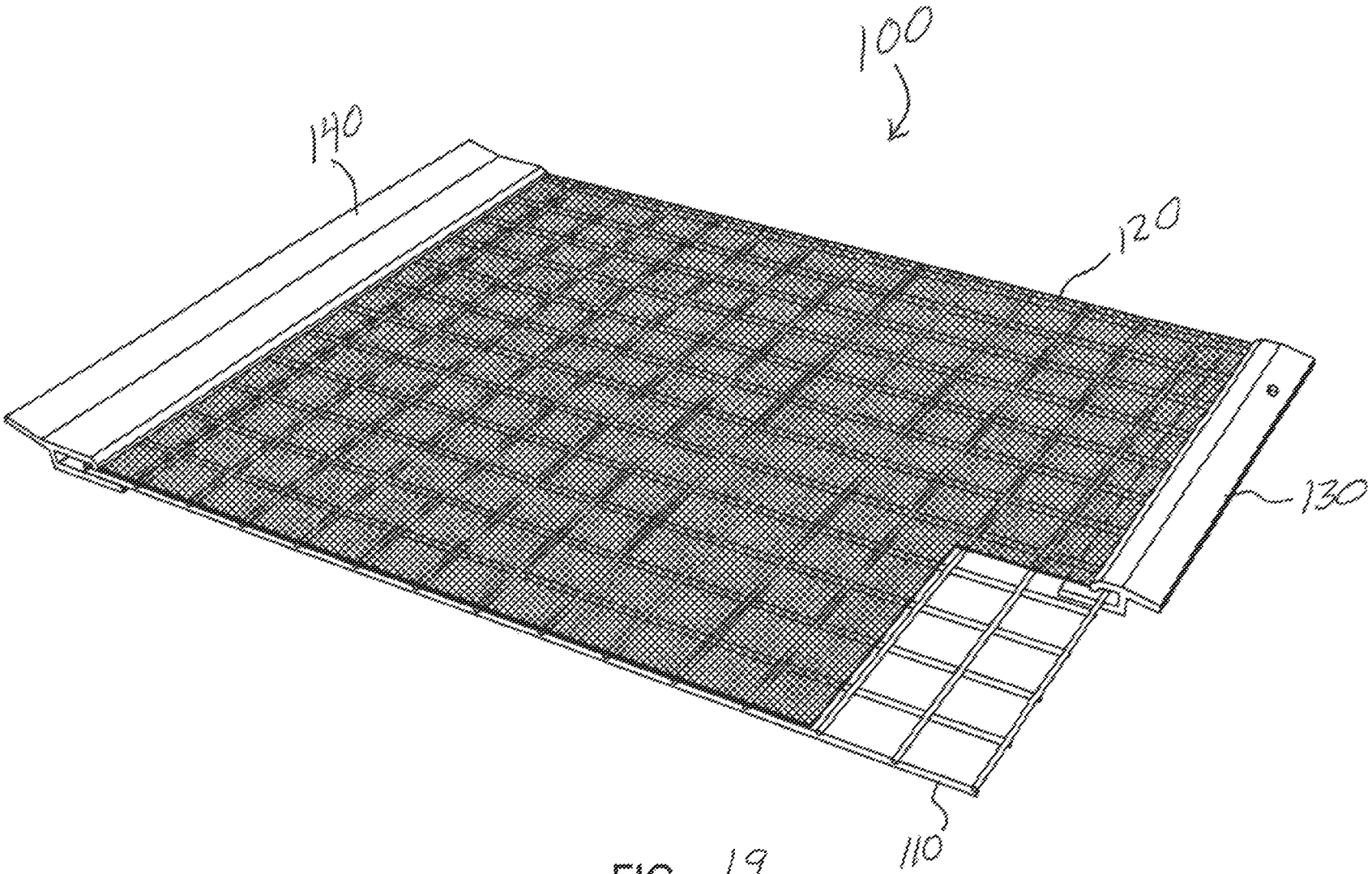
FIG. 19 schematically illustrates a perspective view of the gutter guard system of FIG. 5 with portions of the mesh screen and front receiver removed.

FIG. 19 schematically illustrates the gutter guard assembly 100 with a portion of the mesh screen 120 and front receiver 130 removed to better illustrate the assembly of the components.

Figure 1:
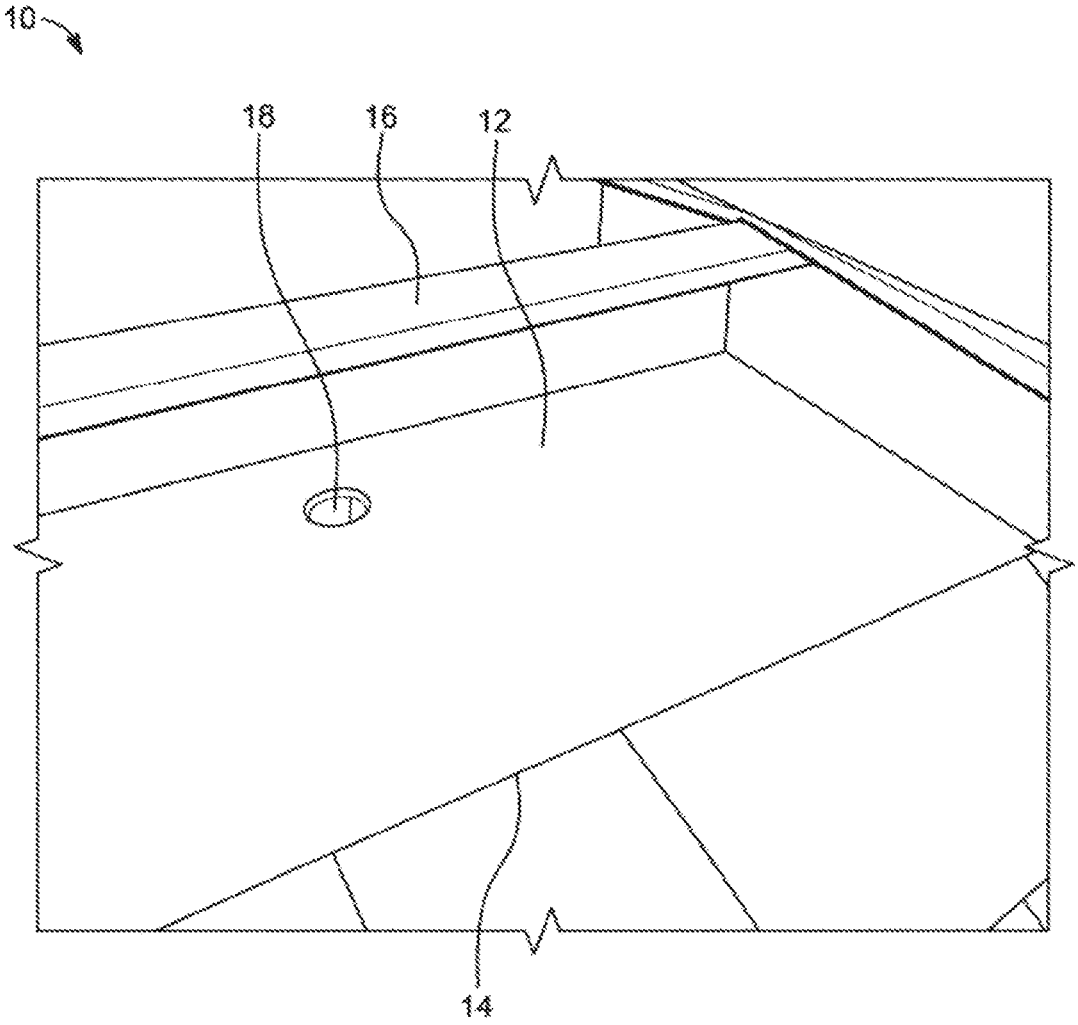
FIG. 1 schematically illustrates an exemplary trough-style gutter system.
Figure 2:
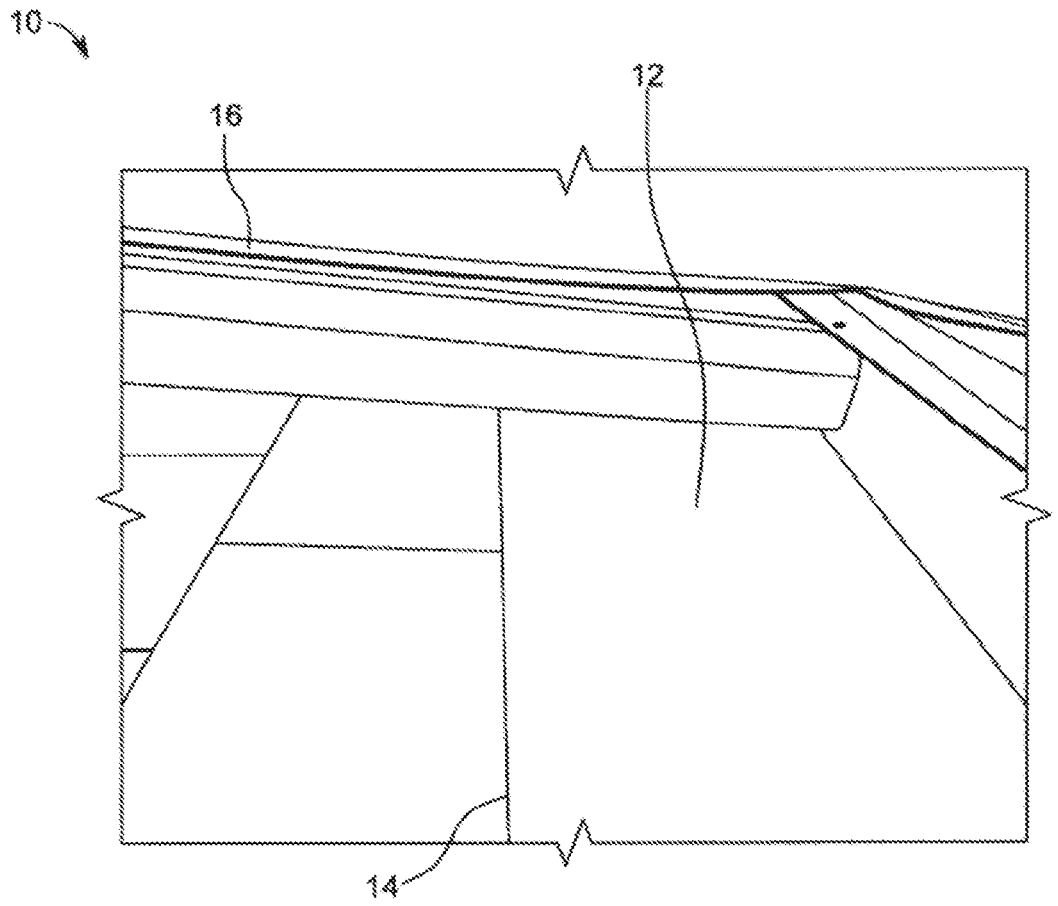
FIG. 2 schematically illustrates another exemplary trough-style gutter system.
Figure 3:
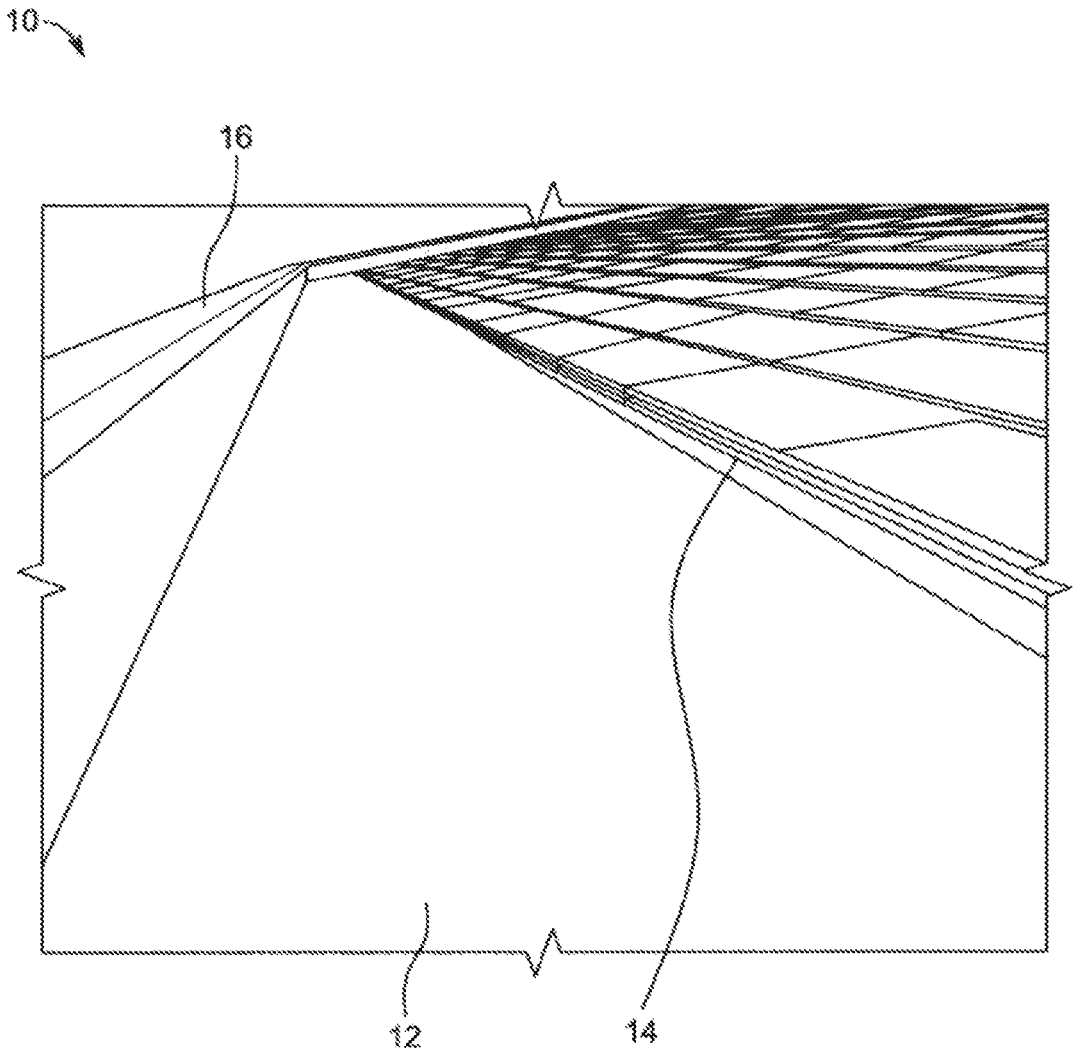
FIG. 3 schematically illustrates yet another exemplary trough-style gutter system.
Figure 4:
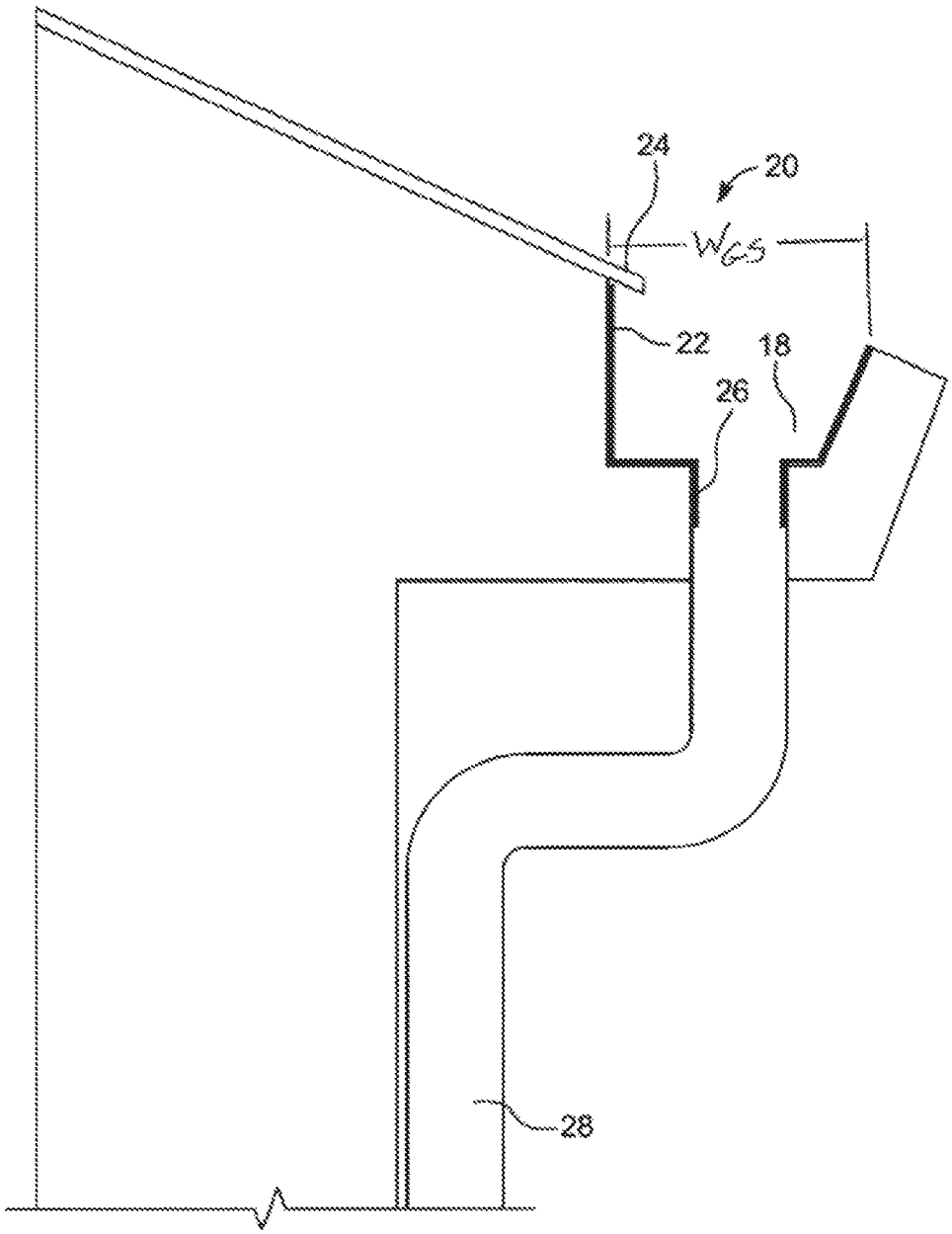
FIG. 4 schematically illustrates an exemplary built-in gutter system.

The main body subassembly 150 is arranged to be easily and quickly customized to accommodate the size and shape required to install the gutter guard assembly 100 over a trough-style or built-in gutter system and to manage the anticipated volume and flowrate of rainwater over the gutter guard system. In one embodiment, the standard width (W) of the main body subassembly 150 is approximately 15 inches. The standard length (L) of the main body subassembly 150 can vary. For example, the length of the main body subassembly 150 can be five feet, eight feet, or any other length that is convenient to manufacture, ship, and work within the field. The standard width of 15 inches for the main body subassembly 150 is greater than most if not all widths of trough-style and built-in gutter systems. It is noted that the term "width" as used for rain gutter systems refers to the distance from the back of the rain gutter system to the front of the rain gutter system as illustrated in FIG. 4, where the width of the rain gutter system is designated as $W_{GS}$. Despite the trough-style and built-in gutter system being custom designed and built, most widths of such rain gutter systems are less than 15 inches. Thus, with a standard width (W) of the main body subassembly 150 of 15 inches, such a main body subassembly 150 can be customized to match most if not all specific trough-style and built-in gutter systems.

The main body subassembly 150 is designed to be bent or otherwise physically manipulated to form a water management feature and/or cut to customize the size and shape of the main body subassembly 150 using standard and available tools. FIGS. 20-28 illustrate examples of bending and/or cutting the main body subassembly 150 to include a water management feature and/or customizing the size and shape of the main body subassembly 150.

Figure 20:
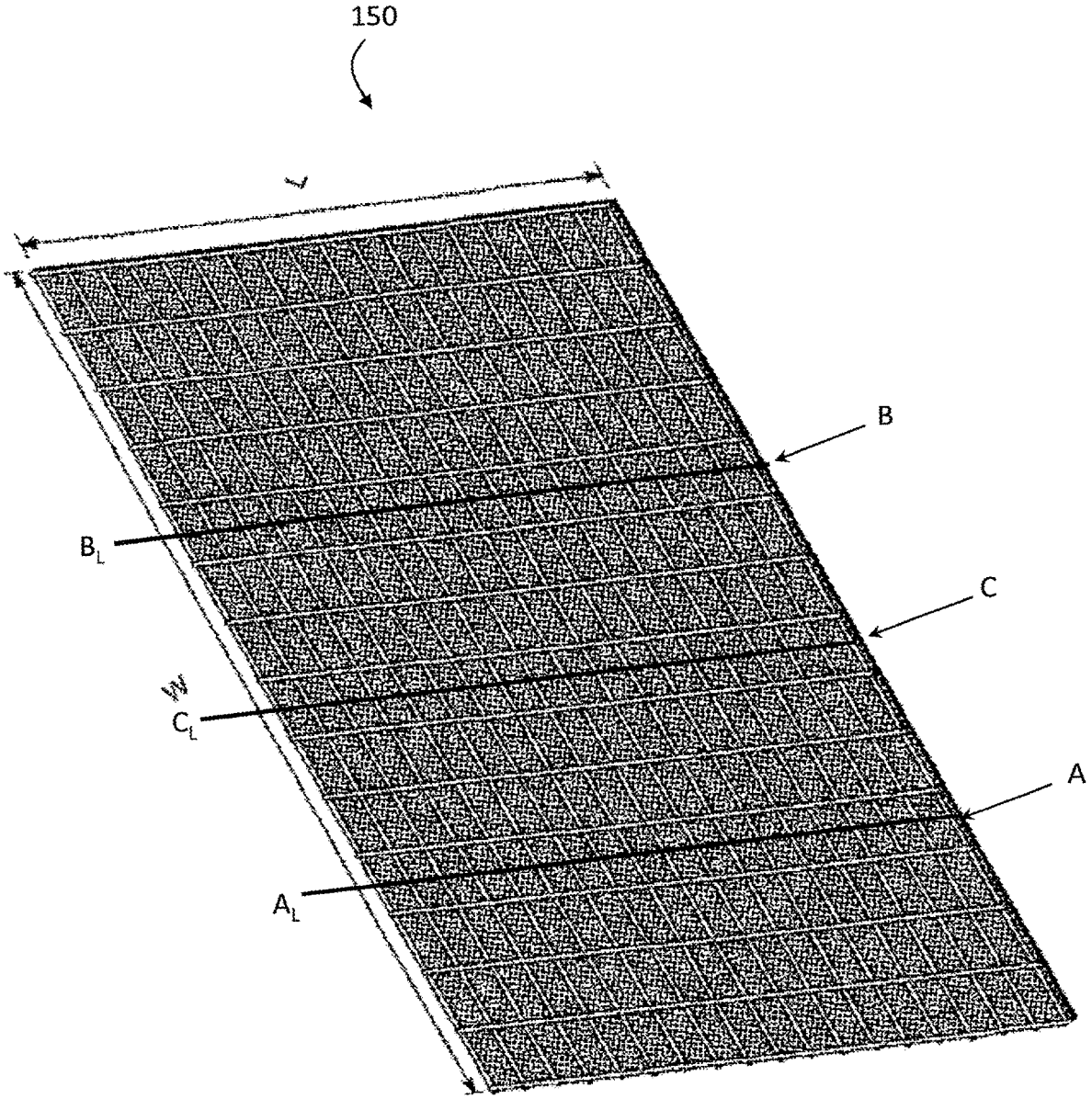
FIG. 20 schematically illustrates a main body and mesh screen assembly with locations identified for physically manipulating the main body and mesh screen assembly to form a water management feature.
Figure 21:
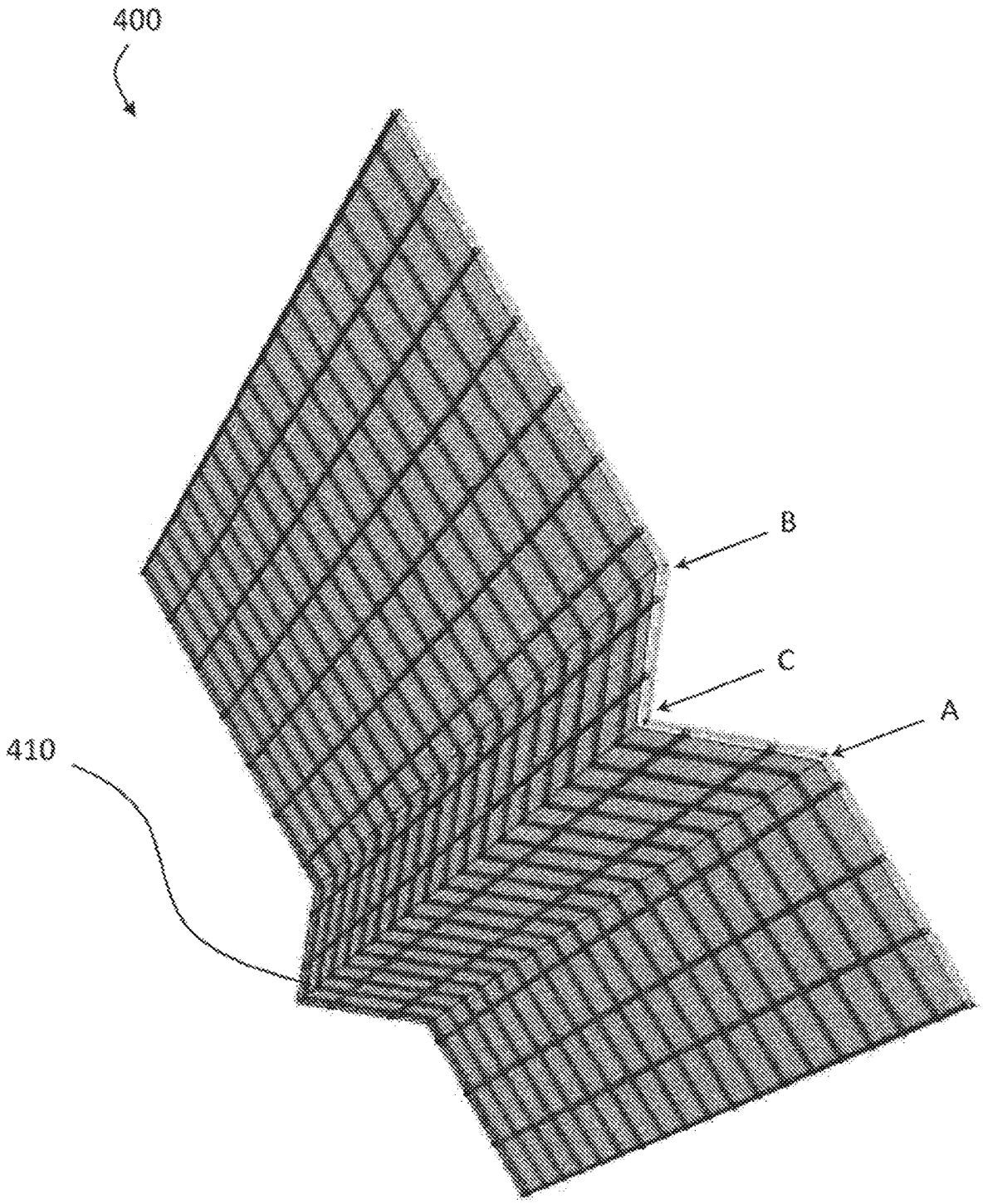
FIG. 21 schematically illustrates the main body and mesh screen assembly of FIG. 20 with physically manipulated to form a water management feature.

As illustrated in FIGS. 20 and 21, the main body subassembly 150 is designed to be bent along three spaced apart lines that are generally parallel to the front edge and rear edge of the main body subassembly 150 to form a water management feature with a triangular cross section that rises above the top surface of the main body subassembly. FIG. 20 illustrates three locations (A, B, C) and three lines ($A_L$, $B_L$, $C_L$) at which the main body subassembly 150 can be bent. FIG. 21 illustrates the resulting main body subassembly 400 with a water management feature 410. In this example, the bends at locations A and B (along lines $A_L$ and $B_L$) result in angles of approximately 135 degrees between the remaining flat sections of the main body subassembly 400 and the water management feature 410. The bend at location C (along line $C_L$) result in an angle of approximately 90 degrees at the peak of the water management feature 410. The illustrated water management feature 410 is exemplary, and water management features can be formed using different angles and arrangements. It is noted that the forming of a water management feature shortens the width of the resulting main body subassembly. However, the initial 15 inch width provides for such shortening while still providing full cover for a rain gutter system.

The water management feature serves as a hurdle or obstacle to the flow and flowrate of rainwater passing along the surface of the gutter guard system. Such a waterflow obstacle or hurdle slows the flowrate of rainwater as it passes over the mesh screen 120. Such slowing of the flowrate of rainwater across the surface of the mesh screen 120 results in the rainwater remaining on the surface of the mesh screen 120 for a longer period of time; thus, providing more opportunity for the rainwater to flow downward, pass through the main body subassembly 400 and into the rain gutter. If the structure has a steep roof or is in an area that experiences heavy or sustained rains, the dimensions and placement of the water management feature 410 can be adjusted to accommodate anticipated high volumes and flowrates of rainwater. As an additional benefit, the water management feature 410 promotes the free flow of air across and through the surface of the main body subassembly 400. Such free flow of air dries any debris resting on the surface of the mesh screen 120 and blows away such debris from the main body subassembly 400. Thus, the main body subassembly 400 with a water management feature 410 facilitates self-cleaning of the gutter guard system.

Figure 22:
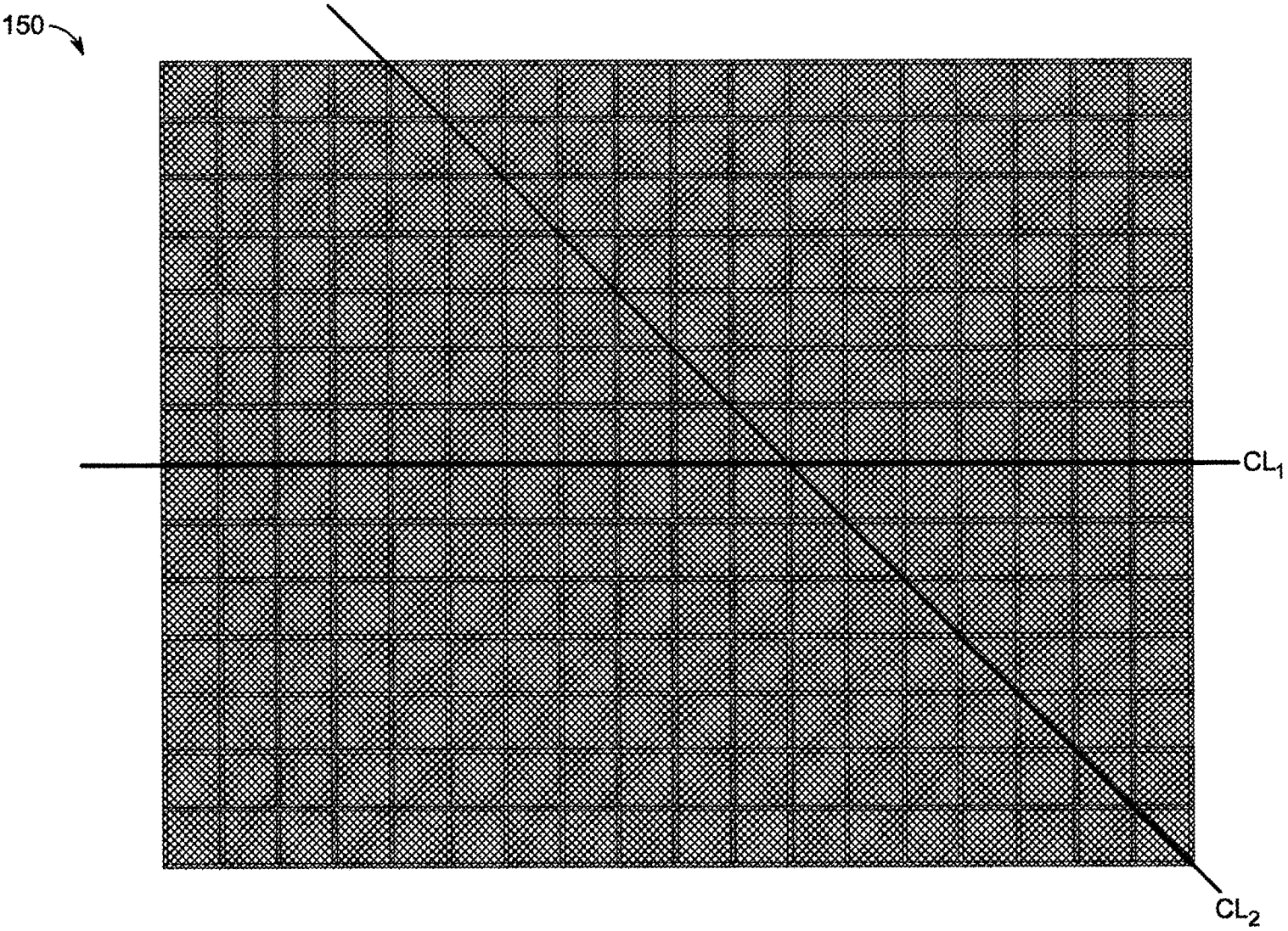
FIG. 22 schematically illustrates exemplary cut lines for customizing a main body subassembly.
Figure 23:
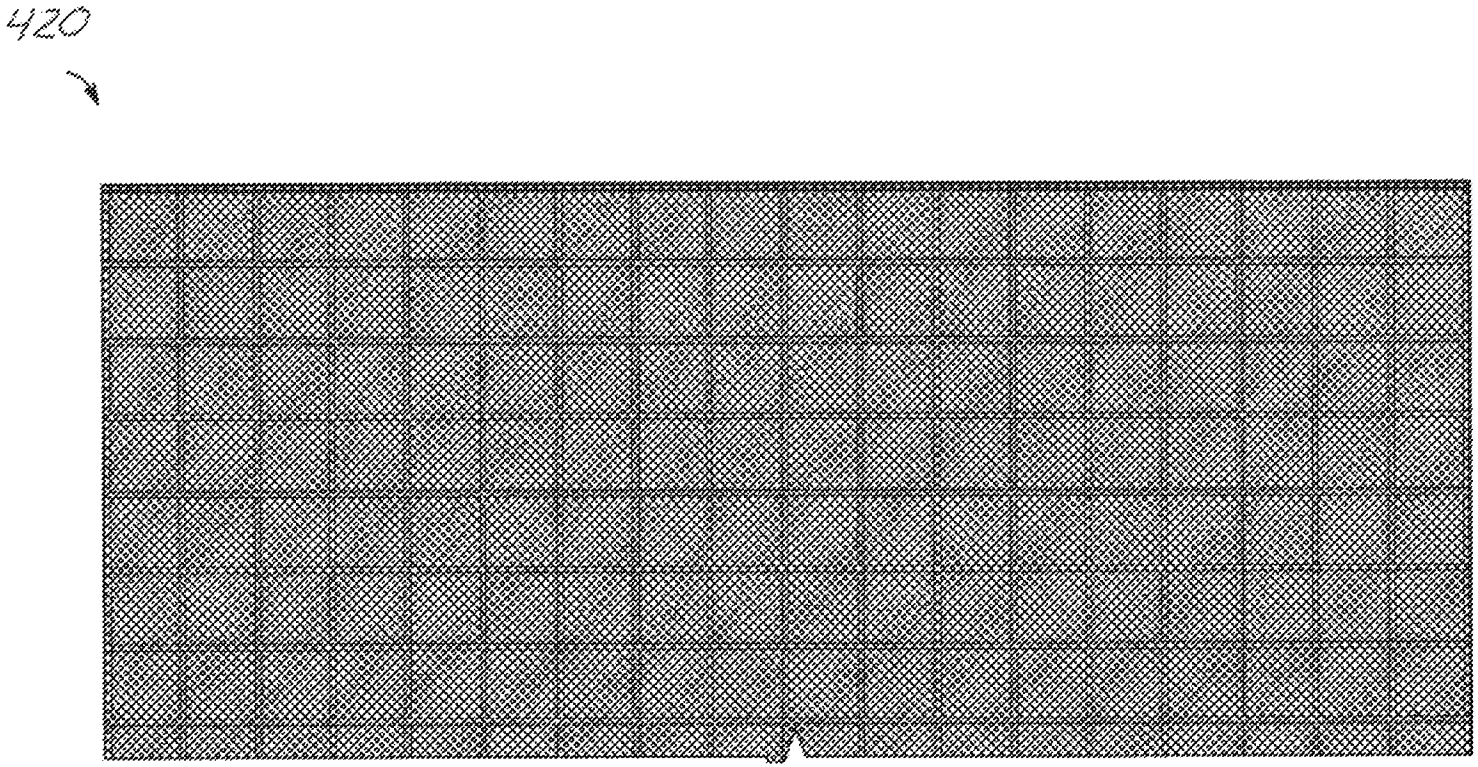
FIG. 23 schematically illustrates the resulting customized main body subassembly when a cut is made along a cut line illustrated in FIG. 22.
Figure 24:
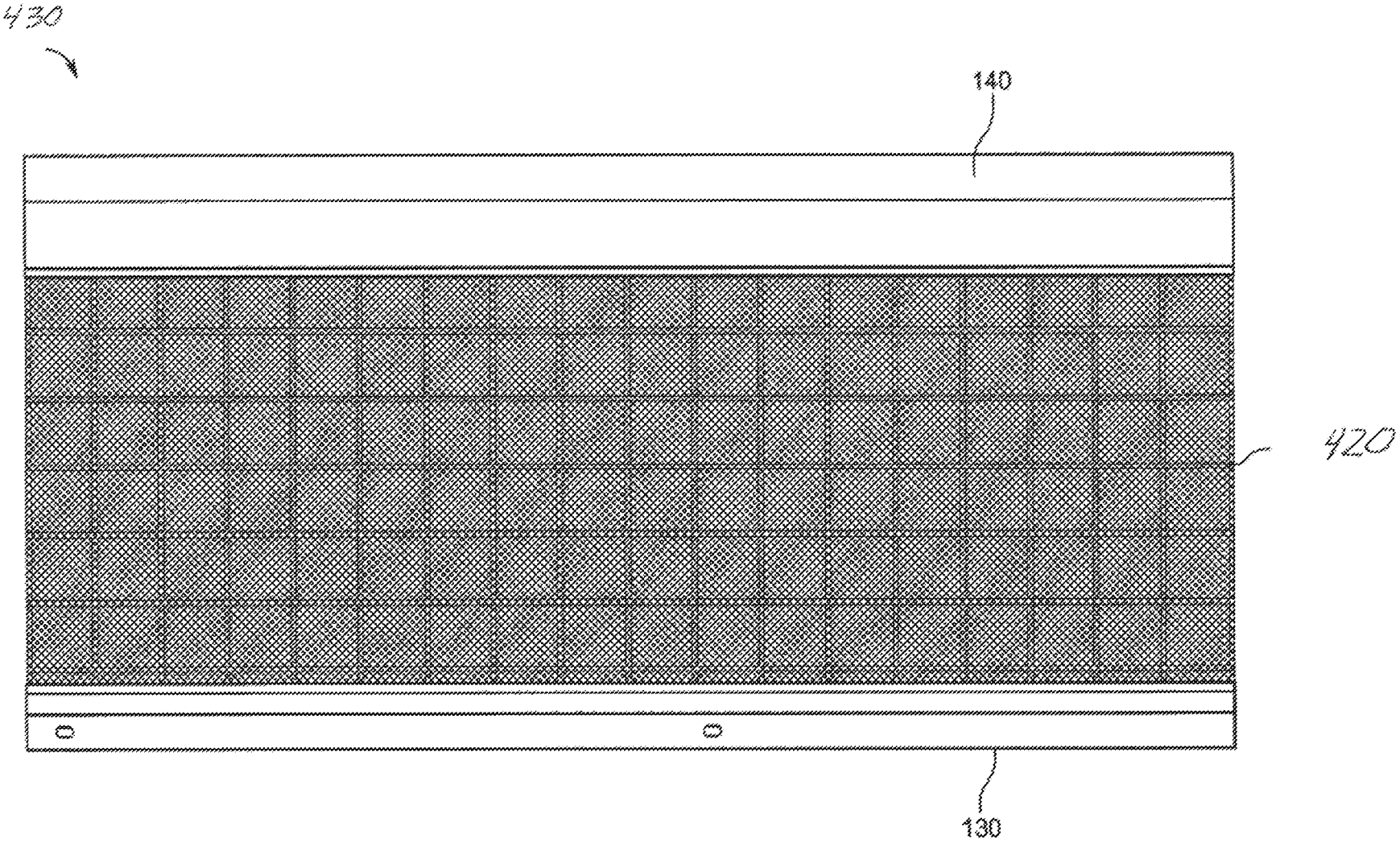
FIG. 24 schematically illustrates the resulting customized gutter guard assembly when using the customized main body subassembly of FIG. 23.

As illustrated on FIG. 22, in one example, to accommodate a trough or box gutter that is approximately 7.5 inches in width, the main body subassembly 150 can be cut along the cut line $CL_1$. Once cut along cut line $CL_1$, the result is a customized main body subassembly 420, as schematically illustrated in FIG. 23. The standard front receiver 130 and rear receiver 140 can be coupled to the customized main body subassembly 420, as illustrated in FIG. 24, to form a customized gutter guard assembly 430. The customized gutter guard assembly 430 can then be installed over the applicable trough-style or built-in gutter system. In one embodiment, the cut edge of the customized main body subassembly 420 is inserted into the rear receiver 140, where the leg 260 of the rear receiver 140 can create a friction fit securing the customized main body subassembly 420 within the rear receiver 140.

Figure 25:
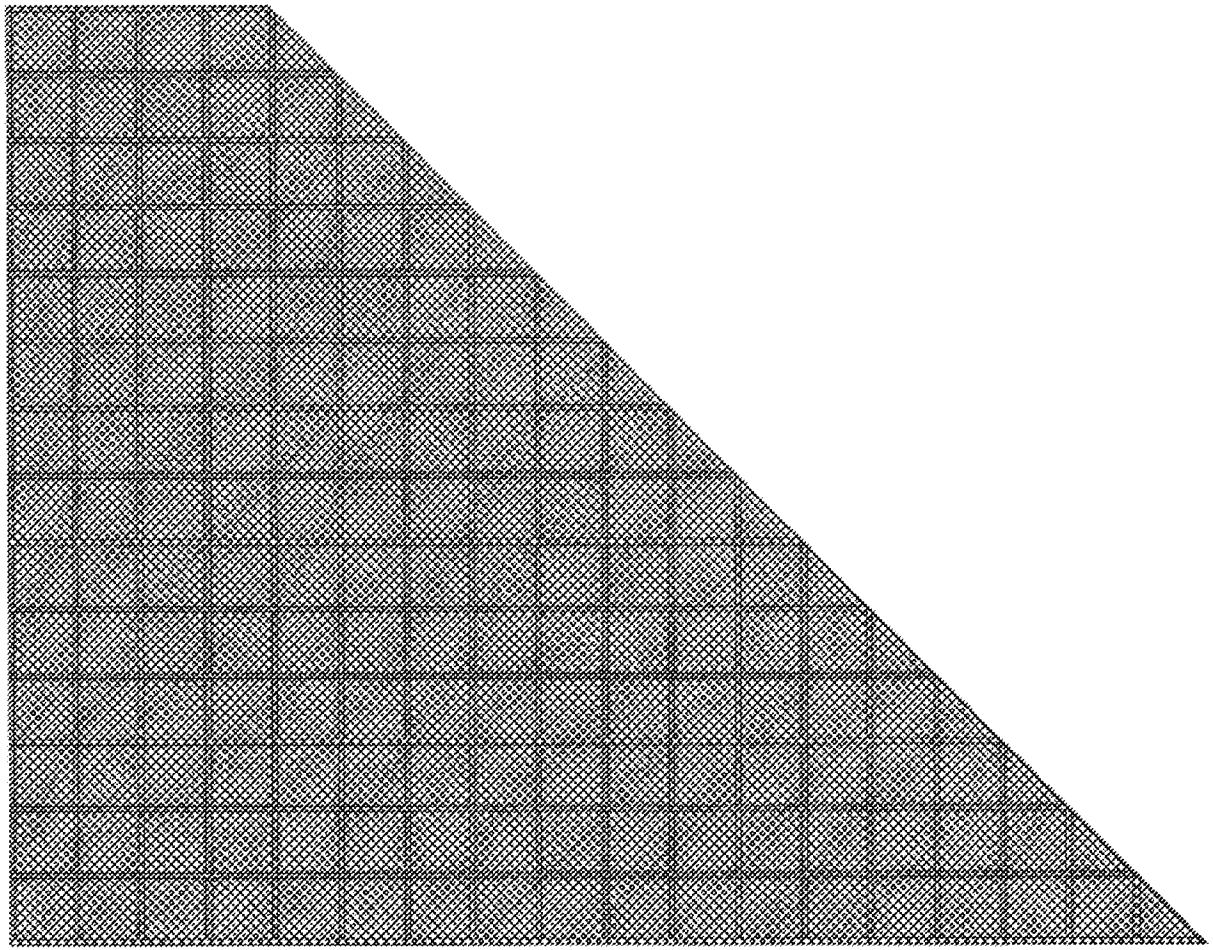
FIG. 25 schematically illustrates the resulting customized main body subassembly when a cut is made along a cut line illustrated in FIG. 22.
Figure 26:
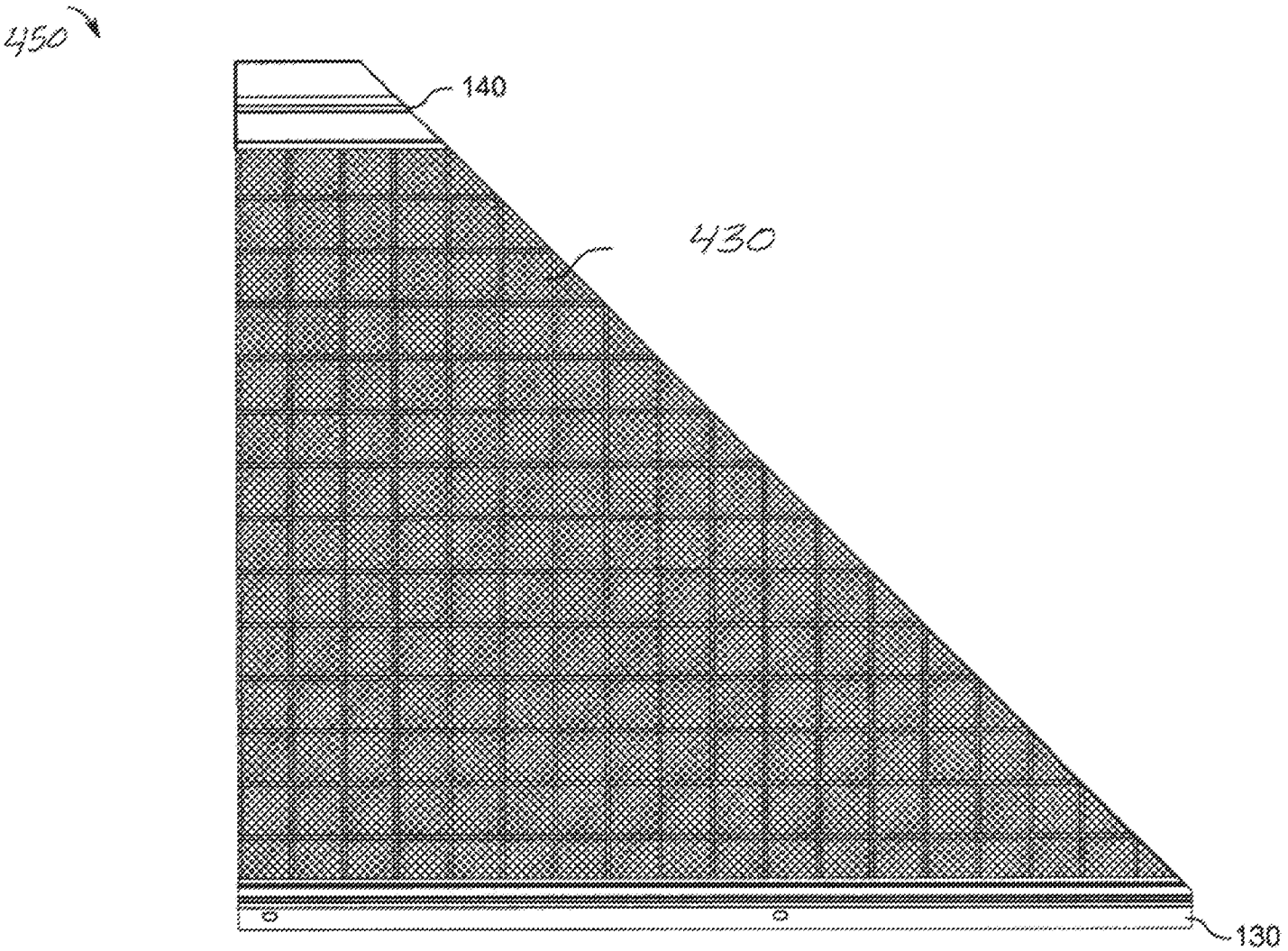
FIG. 26 schematically illustrates the resulting customized gutter guard assembly when using the customized main body subassembly of FIG. 25.

FIG. 22 illustrates another example where the main body subassembly 150 needs to be cut to accommodate a corner of a trough-style or box gutter system. As is further discussed herein, a diagonal cut is required to accommodate a miter joint that can be used to provide gutter guard protection at a corner of a home or structure. To achieve the necessary shape, the main body subassembly 150 can be cut along the cut line $C_{L2}$. Once cut along cut line $C_{L2}$, the result is a customized main body subassembly 440, as schematically illustrated in FIG. 25. A front receiver 130 and a rear receiver 140 can also be cut to accommodate the shape of the customized main body subassembly 440, and the customized front receiver 130 and a rear receiver 140 can be coupled to the customized main body subassembly 440, as illustrated in FIG. 26, to form a customized gutter guard assembly 450. The customized gutter guard assembly 450 can then be installed over the corner of the applicable trough-style or built-in gutter system. Such diagonal cuts can be used to accommodate both inside and outside corner arrangements. It will be understood that cuts can be made generally along both $CL_1$ and $C_{L2}$ to accommodate corner arrangements for specific widths of trough-style or built-in gutter system.

Figure 27:
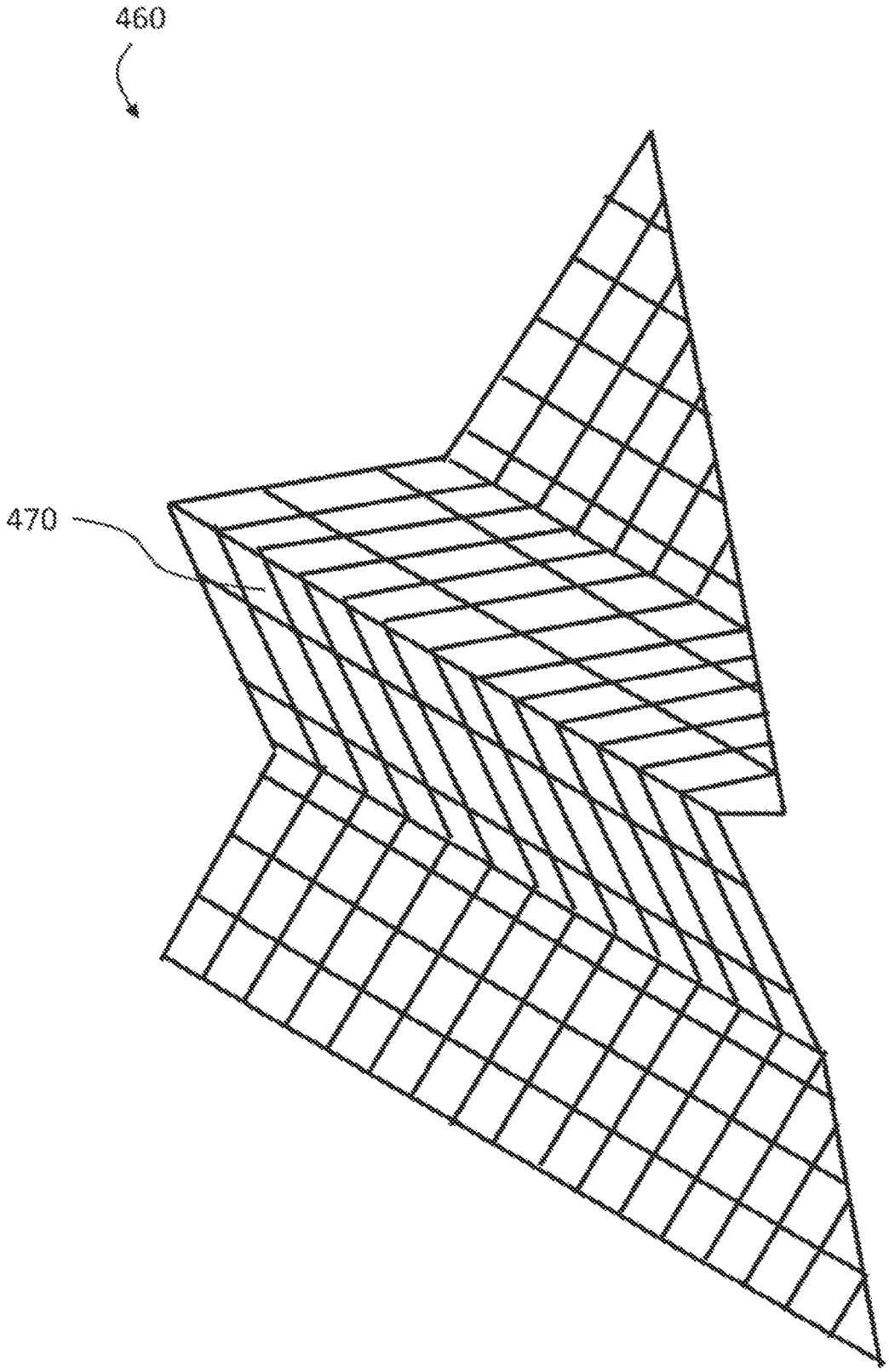
FIG. 27 schematically illustrates a customized main body subassembly with a water management feature formed in the main body subassembly.
Figure 28:
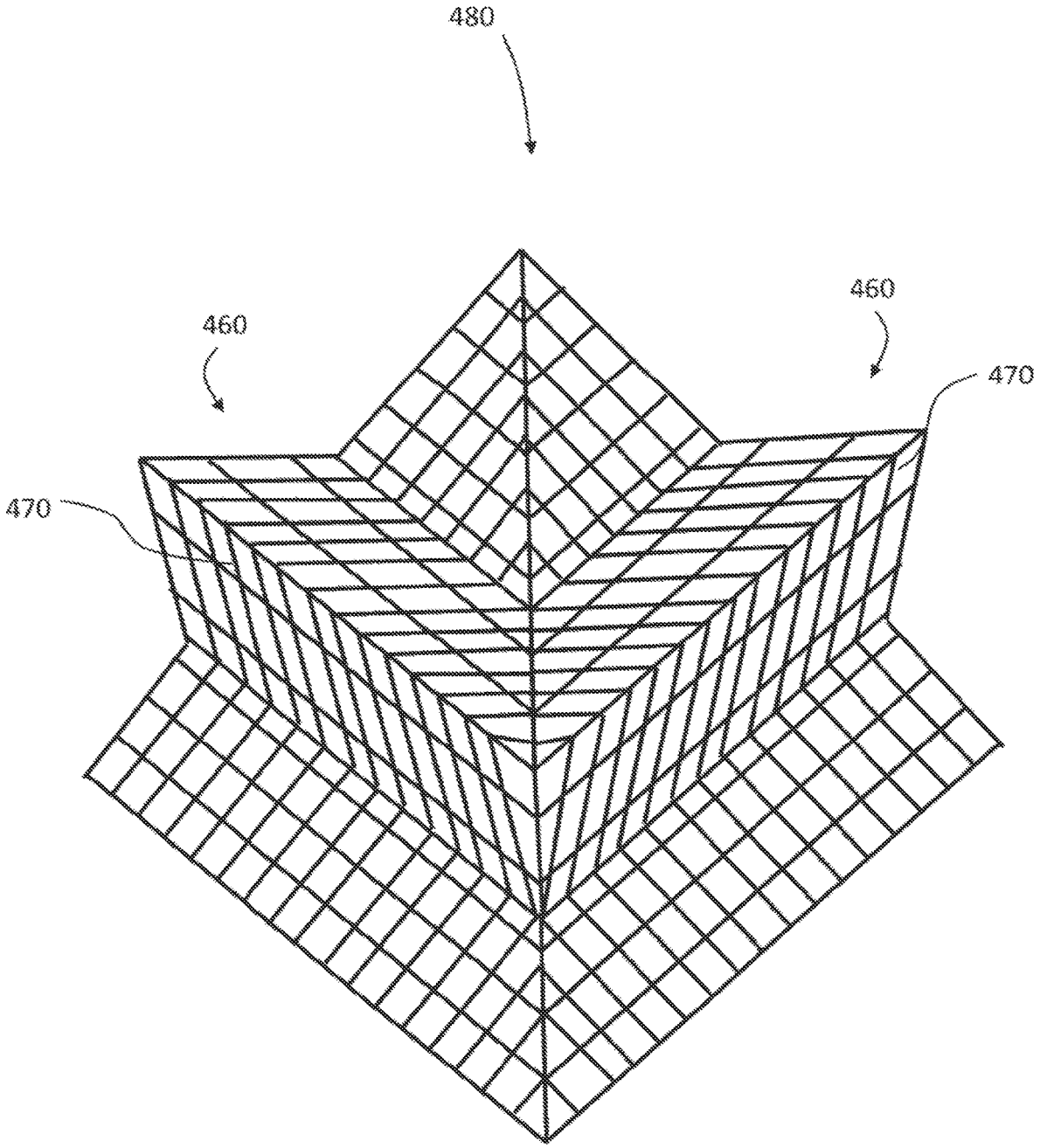
FIG. 28 schematically illustrates a pair of customized main body subassemblies with water management features assembled to cover a corner of a gutter guard system.

Water management features can be formed in sections of customized main body subassemblies for installation over the corner of a trough-style or built-in gutter system. As illustrated in FIG. 27, a customized main body subassembly 460 can be bent or otherwise manipulated to form a water management feature 470. This water management feature 470 is similar to prior description, but specifically arranged to be installed over a corner of a rain gutter system. To fully cover a corner of a rain gutter system, two customized main body subassemblies 460 are formed, each a mirror image of the other. FIG. 28 illustrates two customized main body subassemblies 760 matted together to form an assembly 480 that fully covers the corner of the rain gutter system. In another embodiment of forming customized main body subassemblies for corners of rain gutter systems, the water management feature can first be formed in a main body subassembly (as illustrated in FIG. 21). The resulting main body subassembly 400 can then be trimmed to custom dimensions, including trimmed at a forty-five degree angle to form a customized main body subassembly arranged to be installed over a corner of a rain gutter system.

As discussed herein a main body subassembly or a customized main body subassembly can be bent or otherwise manipulated to form a water management feature within that main body subassembly. One method of bending a main body subassembly is to use a tool commonly referred to as a "brake." A brake typically includes a leading edge, a clamp, and bending plate. The clamp can be deployed to secure a component to be bent in place between a pair of jaws and proximate to the leading edge. The clamp includes an upper handle that can be used to engage and disengage the pair of jaws. The component is secured such that a portion of the component extends past the leading edge. The bending plate is a hinged component that is positioned below the leading edge that can be pulled upward by a lower handle to engage the component to form a bend in the component along the leading edge.

Referring again to FIG. 20, a main body subassembly 150 can be placed in a brake and clamped in place so that line $A_L$ is positioned along the leading edge. The bend plate can be moved upward until the 135 degree angle is formed along line $A_L$. The brake can then be used in a similar manner to form the 90 degree angle at line $C_L$ and the 135 degree angle at line $B_L$. Thus, this method can quickly and precisely form the customized main body subassembly 400 with the water management feature 410 as illustrated in FIG. 20. As will be understood, a brake can be used to form types of water management features in a main body subassembly.

Figure 29:
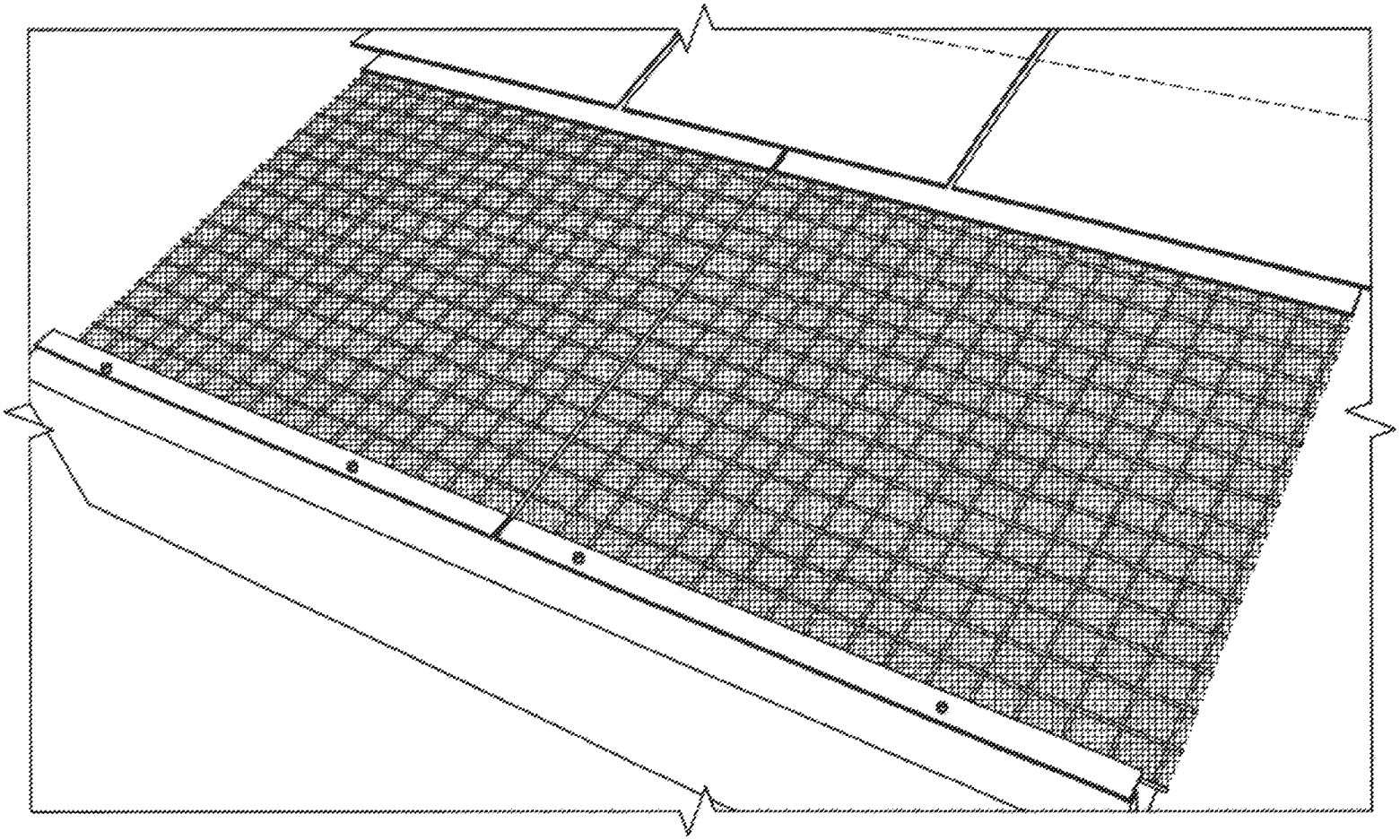
FIG. 29 schematically illustrates a gutter guard system installed on a trough-style gutter system.
Figure 30:
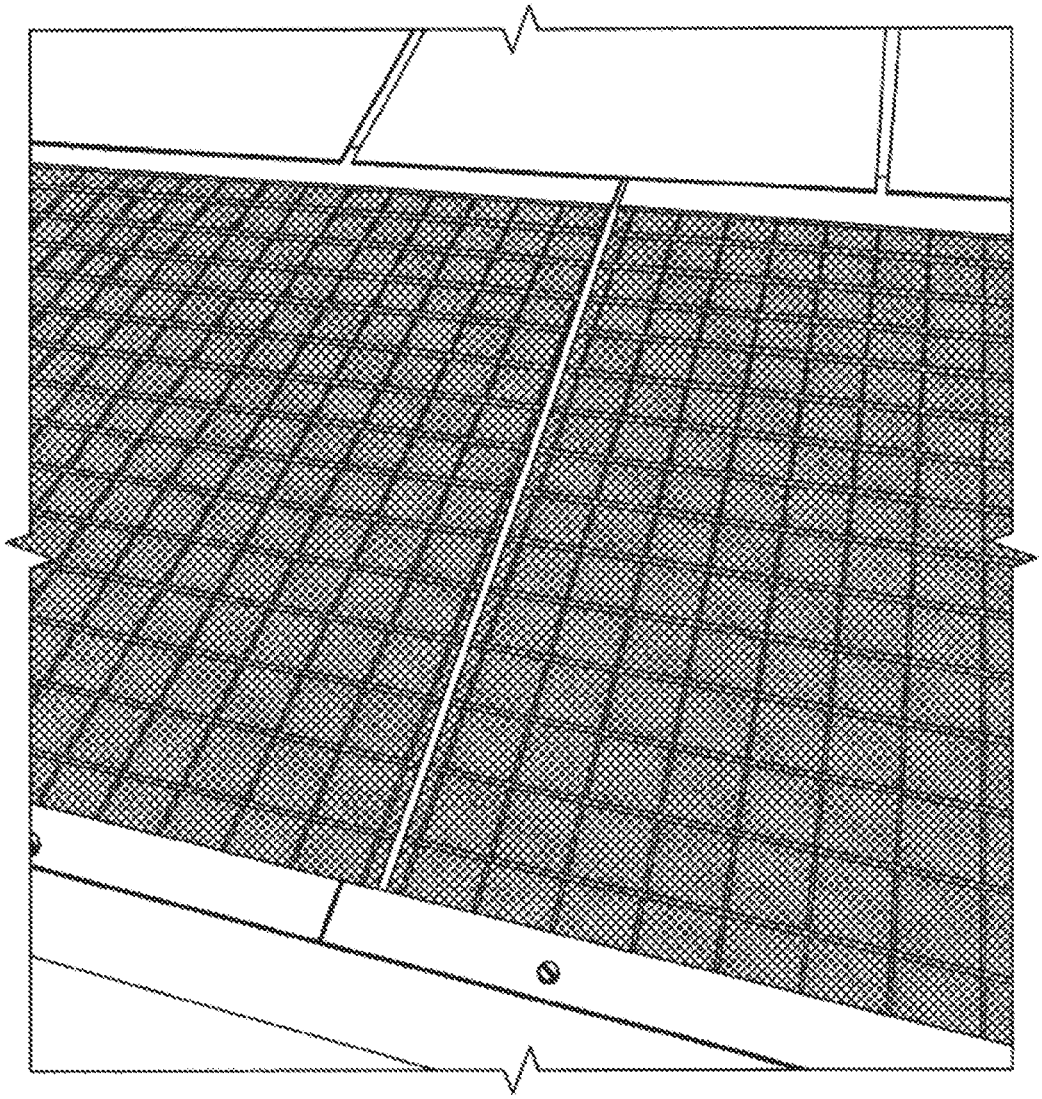
FIG. 30 schematically illustrates another gutter guard system installed on a trough-style gutter system.
Figure 31:
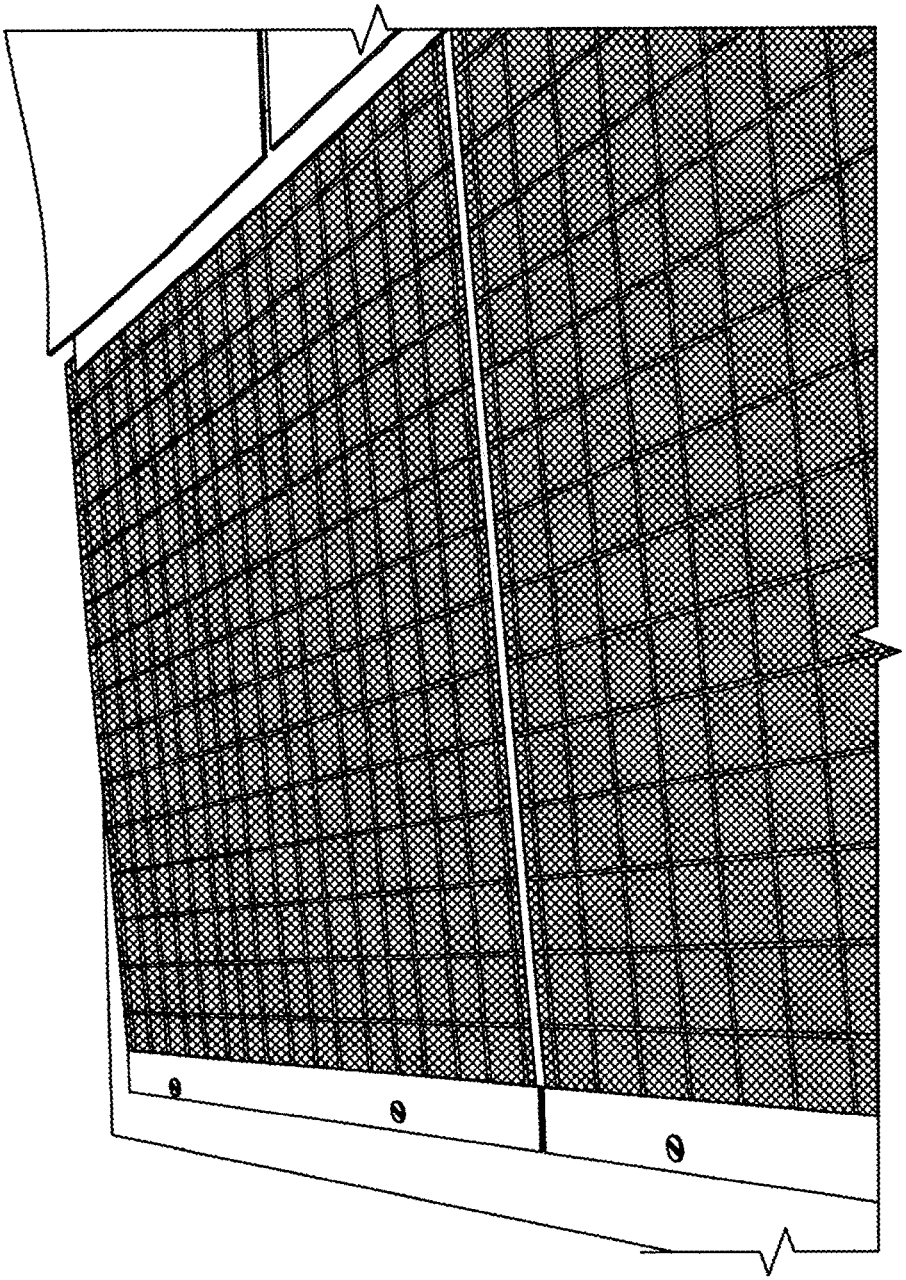
FIG. 31 schematically illustrates another gutter guard system installed on a trough-style gutter system.

FIGS. 29-34 schematically illustrates various customized gutter guard assemblies installed on trough-style gutter systems. FIGS. 29-31 show two sections of a customized gutter guard system. The rear receiver of each section is positioned under the shingles of the roof, and the front receiver is secured to the roof with multiple fasteners. The two sections are joined with a butt joint so that there are no gaps in the overall customized gutter guard system.

Figure 32:
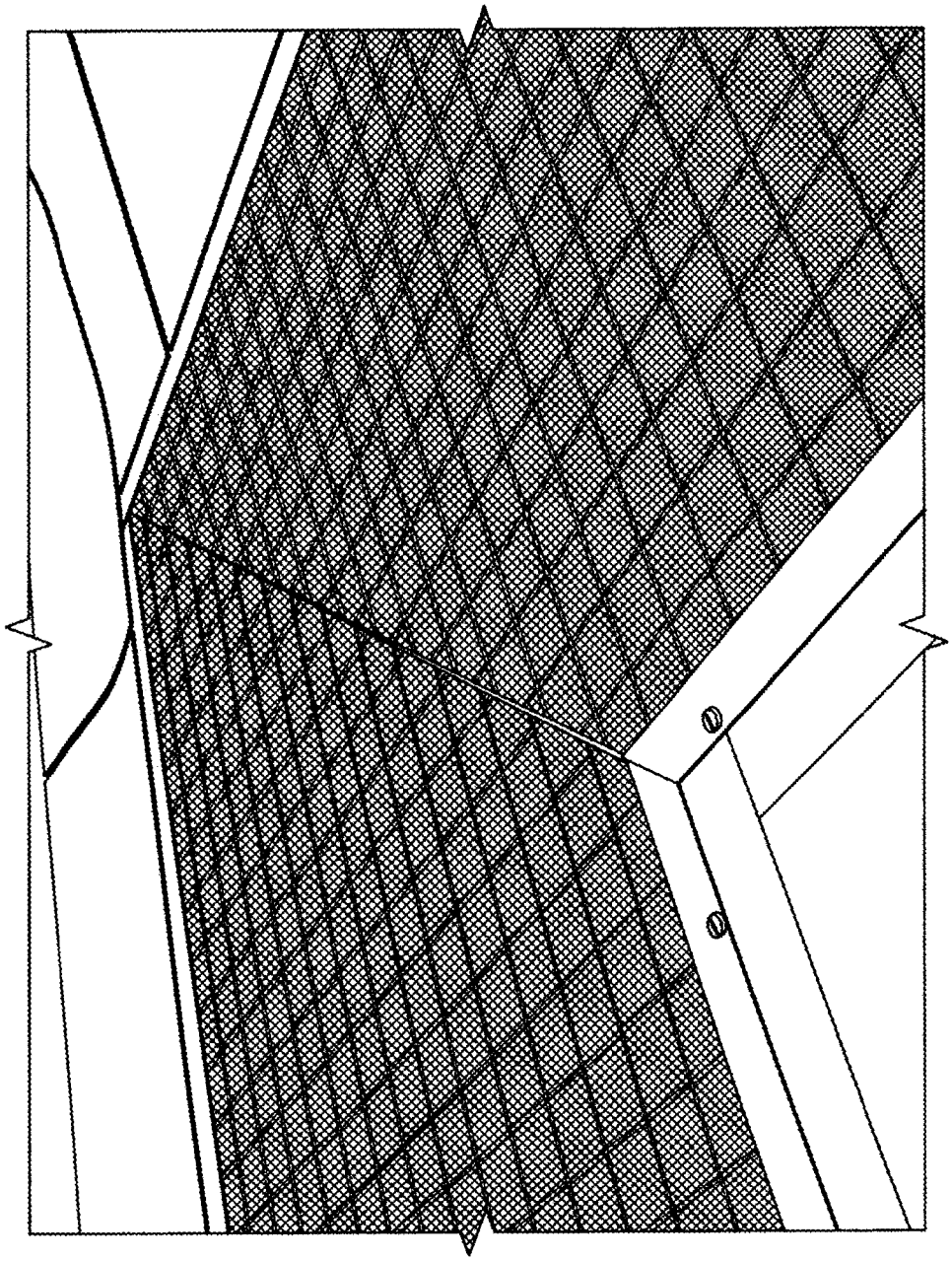
FIG. 32 schematically illustrates a gutter guard system installed on a trough-style gutter demonstrating installation at a corner using a miter joint.
Figure 33:
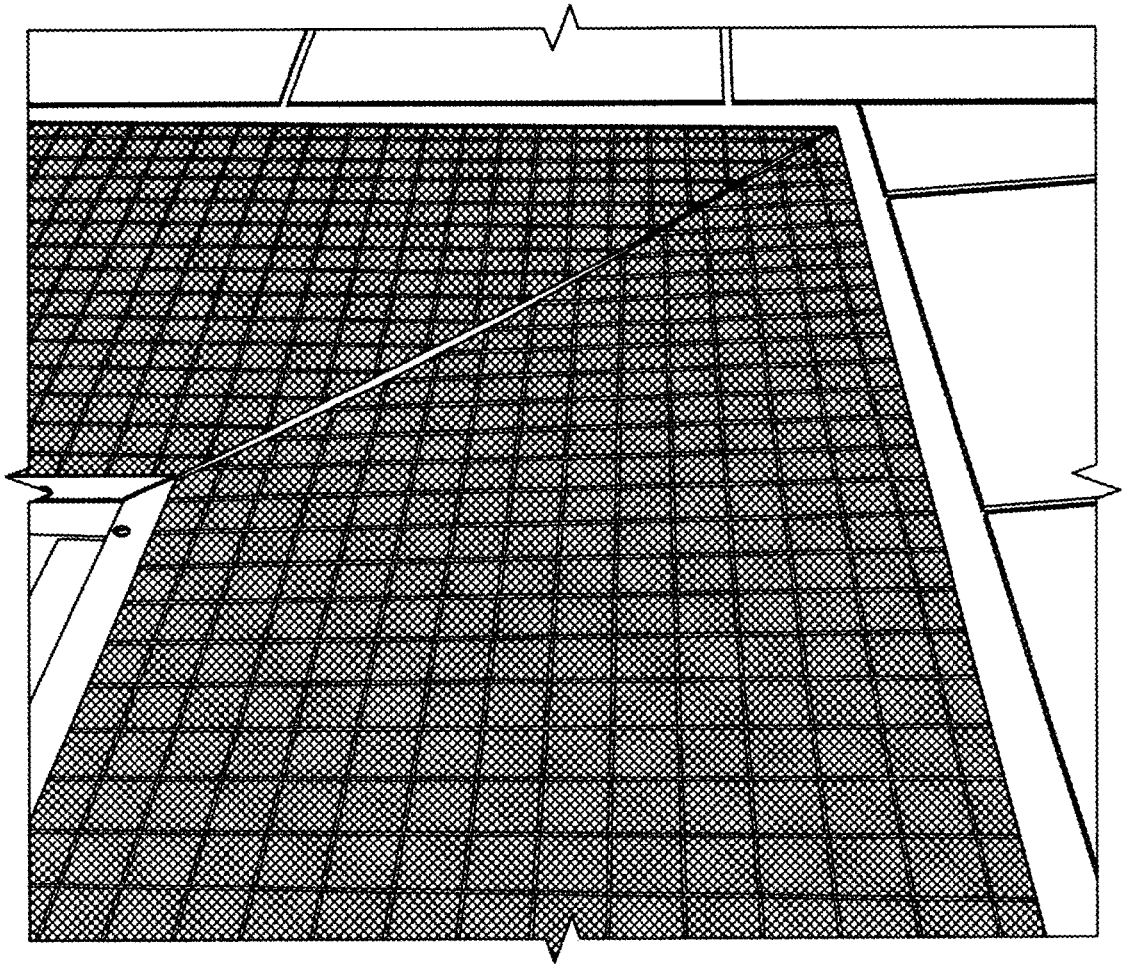
FIG. 33 schematically illustrates another gutter guard system installed on trough-style gutter demonstrating installation at a corner using a miter joint.
Figure 34:
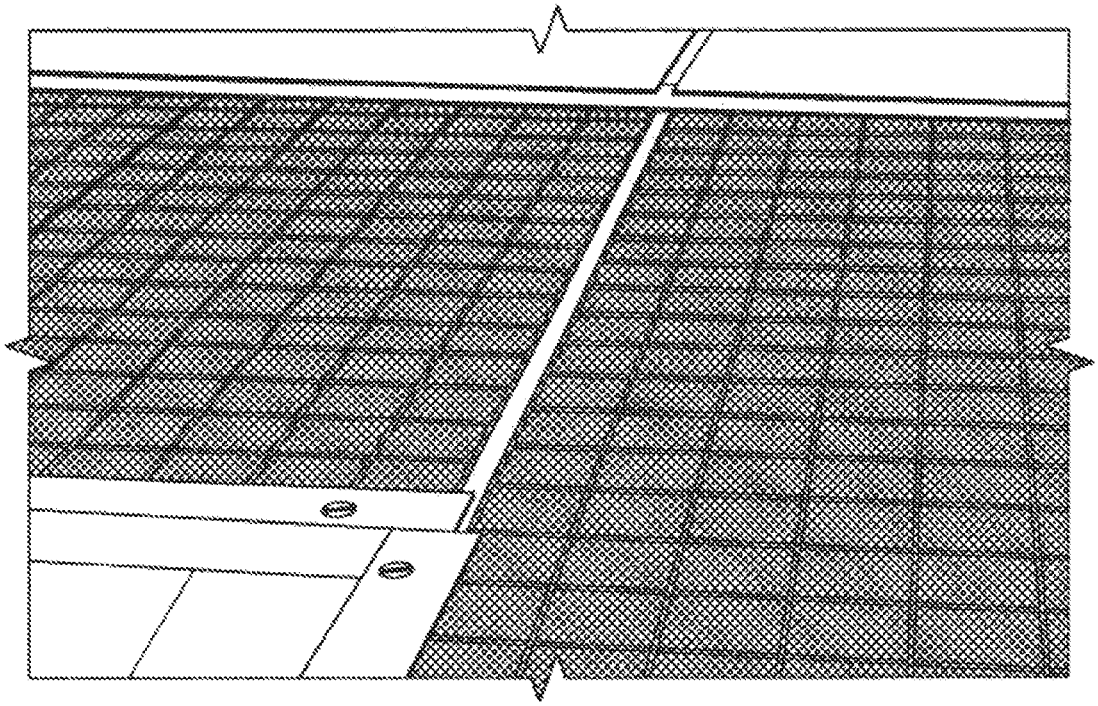
FIG. 34 schematically illustrates another a gutter guard system installed on a trough-style gutter demonstrating installation at a corner using a butt joint.

FIGS. 32 and 33 show a pair of matching sections of a customized gutter guard system that combine to provide protection at an inside corner of a trough-style gutter system. Each section includes a diagonal cut that join together to form a miter joint. The front and rear receivers are also trimmed to accommodate the diagonal cut of the main body subassembly. The rear receiver of each section is positioned under the shingles of the roof, and the front receiver is secured to the roof with multiple fasteners.

FIG. 24 shows a pair of matching sections of a customized gutter guard system that combine to provide protection at an inside corner of a trough-style gutter system. However, in this example, the sections join together to form a butt joint. The rear receiver of each section is positioned under the shingles of the roof, and the front receivers are secured to the roof with fasteners.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A gutter guard system for affixing to an open top side of a rain gutter to prevent debris from entering the rain gutter, the gutter guard system comprising:

a customizable main body subassembly comprising:

a main body defining a plurality of openings therein, and having a top surface and a bottom surface, the main body extending in a longitudinal direction;

a mesh screen layered on and conforming to the top surface of the main body, such that a bottom surface of the mesh screen is in substantial contact with and supported by the top surface of the main body;

a front edge;

a rear edge;

a first flat section of the layered main body and mesh screen disposed adjacent the front edge and extending in the longitudinal direction;

a second flat section of the layered main body and mesh screen disposed adjacent the rear edge and extending in the longitudinal direction; and a water management feature formed in the layered main body and mesh screen, between the first flat section and the second flat section, as a raised hurdle of layered main body and mesh screen projecting upward together from the first and second flat sections, the raised hurdle having a triangular cross section extending in the longitudinal direction;

a front receiver coupled to the front edge of the main body subassembly such that at least a portion of the first flat section is disposed between the front receiver and the water management feature; and a rear receiver coupled to the rear edge of the main body subassembly such that at least a portion of the second flat section is disposed between the rear receiver and the water management feature.

2. The gutter guard system of claim 1, wherein the main body comprises a plurality of metal rods arranged in a lattice structure.

3. The gutter guard system of claim 2, wherein the metal rods are welded together and spaced approximately one inch apart.

4. The gutter guard system of claim 1, wherein the mesh screen comprises a plurality of threads woven into a lattice structure.

5. The gutter guard system of claim 4, wherein the threads are comprised of 316L stainless steel wire with a diameter of approximately 0.0085 inches.

6. The gutter guard system of claim 5, wherein threads are arranged such that there are approximately 30 threads per linear inch in both directions of the lattice.

7. The gutter guard system of claim 4, wherein the threads are arranged so that the open cross-sectional area of the mesh screen is approximately fifty-five percent.

8. The gutter guard system of claim 1, wherein the water management feature includes a first hurdle surface extending from the first flat section to a peak of the water management feature and a second hurdle surface extending from the second flat section to the peak of the water management feature.

9. The gutter guard system of claim 8, wherein the first surface is positioned at a 135 degree angle to the first flat section.

10. The gutter guard system of claim 9, wherein the second surface is positioned at a 135 degree angle to the second flat section.

11. The gutter guard system of claim 10, wherein at the peak of the water management feature, the first surface is positioned at a 90 degree angle to the second surface.

12. The gutter guard system of claim 1, wherein the front receiver comprises:

an upper member running the length of the front receiver;

a lower member running the length of the front receiver;

a connecting member connecting the upper member and lower member;

and a leg extending downward from the upper member; and a channel formed by the upper member, lower member, connecting member, and the leg.

13. The gutter guard system of claim 12, wherein the front edge of the main body is positioned in the channel.

14. The gutter guard system of claim 13, wherein the front edge of the main body is engaged in a friction fit with the channel.

15. The gutter guard system of claim 1, wherein the rear receiver comprises:

an upper member running the length of the rear receiver;

a lower member running the length of the rear receiver;

a connecting member connecting the upper member and lower member;

and a leg extending downward from the upper member; and a channel formed by the upper member, lower member, connecting member, and the leg.

16. The gutter guard system of claim 15, wherein the rear edge of the main body is positioned in the channel.

17. The gutter guard system of claim 16, wherein the rear edge of the main body is engaged in a friction fit with the channel.

18. The gutter guard system of claim 1, wherein the rear receiver comprises:

first member running the length of the rear receiver;

a second member running the length of the rear receiver parallel to the first member;

a connecting member running the length of the rear receiver perpendicularly to the first member and second member and connecting the first member and second member; and a channel formed by the first member, second member, and a portion of the connecting member.

19. The gutter guard system of claim 18, wherein the rear edge of the main body is positioned in the channel.

20. The gutter guard system of claim 1, wherein the main body is configured to be trimmable along a line that is generally parallel to the front edge and rear edge of the main body, so as to permit the customization of the dimensions of the gutter guard system.

21. The gutter guard system of claim 1, wherein the main body is configured to be trimmable along a line that is generally at an angle to the front edge and rear edge of the main body, so as to permit the customization of the dimensions of the gutter guard system.

22. The gutter guard system of claim 21, wherein the angle is generally forty-five degrees with reference to the front edge and rear edge of the main body.

* * * * *